US007096550B2

(12) United States Patent
Klann

(10) Patent No.: US 7,096,550 B2
(45) Date of Patent: Aug. 29, 2006

(54) SYSTEM FOR TENSIONING A COIL SPRING

(75) Inventor: Horst Klann, Villingen-Schwenningen (DE)

(73) Assignee: Klann Spezial-Werkzeugbau GmbH, (DE)

( * ) Notice: Subject to any disclaimer, the term of this patent is extended or adjusted under 35 U.S.C. 154(b) by 91 days.

(21) Appl. No.: 10/990,235

(22) Filed: Nov. 16, 2004

(65) Prior Publication Data

US 2005/0140076 A1 Jun. 30, 2005

(30) Foreign Application Priority Data

Dec. 24, 2003 (DE) ..... 103 61 597

(51) Int. Cl.
*B23P 19/04* (2006.01)

(52) U.S. Cl. ..... 29/227; 254/10.5

(58) Field of Classification Search ..... 29/215, 29/216, 217, 218, 225, 227, 258; 254/10.5
See application file for complete search history.

(56) References Cited

FOREIGN PATENT DOCUMENTS

EP 0 115 774 8/1984

EP 0 271 782 6/1988

*Primary Examiner*—Robert C. Watson
(74) *Attorney, Agent, or Firm*—McGlew & Tuttle, PC

(57) ABSTRACT

A system for tensioning a coil spring with a spring vice (120), comprising a first and second pressure plate (40, 1) each, which are disk-shaped or strip-shaped and have a central opening (63, 3) each. The pressure plates (40, 1) can be caused to engage a spring turn of the coil spring each to tension the coil spring. A tensioning device is formed from a threaded pipe and a threaded spindle (41). The threaded spindle (41) has a spindle head (85), which is provided with a wrench profile and via which the threaded spindle (41) is axially supported at the first pressure plate (40) by means of a thrust bearing (43) and wherein the threaded pipe (2) has, at its end located axially opposite the spindle head (85), radially projecting radial fingers (31, 32), by which the threaded pipe (2) can be brought into pulling connection with the second pressure plate (1). To make it possible to embody a tensioning device (2, 41) with the smallest possible diameter, the first pressure plate (40) has a first guide (91) at a radially outer edge area, which can be caused to engage a second guide (90) of the second pressure plate (1). The second guide is arranged in the radially outer edge area of the second pressure plate (1), in an axially adjustable manner. For the pressure plates (1, 40) to be axially adjustable by the two guides (90, 91) and to be connected with one another detachably and nonrotatably in relation to one another.

27 Claims, 9 Drawing Sheets

SYSTEM FOR TENSIONING A COIL SPRING

CROSS REFERENCE TO RELATED APPLICATIONS

This application claims the benefit of priority under 35 U.S.C. § 119 of German Application DE 103 61 597.0 filed Dec. 24, 2003, the entire contents of which are incorporated herein by reference.

FIELD OF THE INVENTION

The present invention pertains to a system for tensioning a coil spring with a spring vice, comprising a first and second pressure plate each, which are disk-shaped or strip-shaped and have a central opening each and can be caused to engage a spring turn each of the coil spring for tensioning the coil spring, as well as a tensioning device, which is formed from a threaded pipe and a threaded spindle, wherein the threaded spindle has a spindle head, which is provided with a wrench profile and via which the threaded spindle is axially supported at the first pressure plate by means of a thrust bearing, and wherein the threaded pipe has, at its end located axially opposite the spindle head, radially projecting radial fingers, by which the threaded pipe can be brought into pulling connection with the second pressure plate, and wherein the distance between the pressure plates during the screwing in of the threaded spindle into the threaded pipe can be shortened.

BACKGROUND OF THE INVENTION

Systems of the type of this class for tensioning a coil spring are known, for example, from EP 0 115 774 B1 and EP 0 271 782 B1.

The subject of EP 0 115 774 B1 is a spring vice, which has two pressure plates, the distance between which can be changed by means of a tensioning device during the tensioning of a coil spring. These pressure plates have a disk-shaped design and have a circular base each. To tension the coil spring, these two pressure plates with their tensioning surface, which has a pitch, are caused to engage a spring turn each of the coil spring. The spring turns accommodated are located in the end areas of the coil spring axially between the end turns of the coil spring. The tensioning device is subsequently caused to engage the two pressure plates.

The tensioning device comprises here a threaded pipe, which has two diametrically opposite, radially outwardly projecting radial fingers at one of its ends. The corresponding pressure plate has a central opening, through which the threaded pipe with its radial fingers can be passed. Two hollows, which can be caused to be engaged by the radial fingers after a rotation of the threaded pipe by about 90E around the central longitudinal axis of the threaded pipe, are provided in the pressure plate axially on the outside in the edge areas of the opening. The threaded pipe with its radial fingers is thus in pulling connection with the pressure plate via these hollows of the pressure plate, adapted to rotate in unison. Furthermore, the tensioning device comprises a threaded spindle, which has a wrench head, which is in turn provided with a wrench profile designed as a hexagon insert bit. This threaded spindle is mounted in a guide pipe and is supported via a thrust bearing in a head part of the guide pipe, which said head part is located axially opposite the threaded pipe. The guide pipe can be brought into connection with the threaded pipe via elements securing against rotation, adapted to rotate in unison. Positive-locking elements, by means of which the guide pipe can be caused to engage the pressure plate located opposite the threaded pipe, adapted to rotate in unison, are provided at the guide pipe in the area of the head part.

The threaded spindle is screwed into the threaded pipe during the tensioning, so that the guide pipe is pushed over the threaded pipe. The distance between the head part with its two positive-locking elements and the radial fingers of the threaded pipe changes at the same time, so that a coil spring mounted between the two pressure plates is shortened and thus tensioned.

Because of the guide pipe provided and the elements securing against rotation, which project radially to the outside, the tensioning device has a relatively large external diameter here, so that this tensioning device cannot be used for any application on a motor vehicle. Such coil springs of a motor vehicle, which are to be tightened, are seated between an axle body and the body of a motor vehicle. Designs in which the coil spring is accommodated with its end turn on a dome-shaped guide pin are known here for mounting especially at the axle body. The end turn has a relatively small turn diameter, so that the receiving lug also has a relatively small diameter only. The receiving lug is usually provided with a central through hole, whose diameter is likewise relatively small, so that the tensioning device of the prior-art spring vice cannot be passed through the through hole. This means in turn that the diameter of the tensioning device cannot be smaller than a minimum diameter because of the elements securing against rotation, which are provided over the guide pipe. The consequence of this is in turn that the threaded spindle can be used only without a guide pipe and consequently also without the means securing against rotation only in such axle designs with a relatively small through hole, because the threaded spindle itself with its spindle head has such a small diameter that this threaded spindle can be passed through the small through hole of the axle body.

Similarly, the tensioning device in the subject of EP 0 271 782 B1 is provided with a relatively large external diameter. This is due in the subject of EP 0 271 782 B1 to the fact that a guide pipe, which is connected with a coupling pipe, adapted to rotate in unison, is likewise provided here for the threaded pipe. This coupling pipe establishes, in turn, a connection with the threaded pipe, in such a way that they are adapted to rotate in unison, and the guide pipe, the coupling pipe and the threaded pipe can be pushed telescopically into one another. The threaded spindle, which can be screwed into the threaded pipe in this case as well, is likewise mounted in a head part at the outer end of the guide pipe and is supported therein axially via a thrust bearing. This tensioning device can also be used only if the guide pipe and the coupling pipe are omitted, because the threaded spindle with its spindle head can be passed in this case through a relatively narrow through hole of an axle body and can be caused to engage the pressure plate located axially opposite the threaded pipe. However, the consequence of this is that the prior-art spring vice must do without a means securing the two pressure plates against rotation in both cases. However, since this is extremely dangerous for the operating personnel during the operation, such a system for tensioning a coil spring can be used only conditionally.

SUMMARY OF THE INVENTION

Thus, the object of the present invention is to design a system of the type of this class for tensioning a coil spring such that the tensioning device of this system can be passed through extremely narrow through holes of an axle body and a means for securing the two pressure plates against rotation does not have to be omitted.

The object is accomplished according to the present invention by the first pressure plate being provided in its radially outer edge area with a first guide means, which can be caused to engage a second guide means of the second pressure plate, which second guide means is arranged in the radially outer edge area of the second pressure plate, in an axially adjustable manner, and by the pressure plates being axially adjustable via the two guide means and detachably connected with one another, nonrotatably in relation to one another.

The design of the system for tensioning a coil spring according to the present invention makes it possible to embody a tensioning device for a spring vice which has an extremely small space requirement in terms of its diameter. Due to the two guide means in the radially outer edge areas of both pressure plates, no guide pipe with a larger diameter is necessary for securing the pressure plates against rotation in the area of the tensioning device. The tensioning device with its threaded spindle and its threaded pipe can be made so small in terms of its diameter that the tensioning device can be passed through extremely small through holes of an axle body. Thus, both the threaded pipe and the threaded spindle can still be made with a sufficiently large cross section in order to make it possible to apply even extremely strong tensioning forces of up to 2 tons without a risk of rupture. Due to the fact that the two guide means of the two pressure plates are connected detachably with one another, the handling of the spring vice of this system according to the present invention is extremely simple, and the two pressure plates can be caused to engage the spring turns of a coil spring to be tensioned in a simple manner.

Thus, to tension a coil spring installed in a motor vehicle, the "second," upper pressure plate is first to be caused to engage one of the spring turns of the coil spring to be tensioned. This pressure plate can subsequently be rotated upward to a maximum along the spring turns of the coil spring to the top end of the coil spring. The guide means now extends essentially on the outside in parallel to the coil spring, so that this rotary movement is not hindered by the guide means. After the second, upper pressure plate has been positioned correctly, the threaded pipe with its radial fingers is brought into pulling connection with the upper pressure plate in the known manner. The threaded pipe can be introduced for this purpose into the coil spring from the bottom through the through hole of the axle body as well as the opening of the lower pressure plate. After rotation by 90E, the radial fingers enter corresponding hollows of the second, upper pressure plate, which are arranged in the circumferential area of the opening on the top side in the pressure plate. The first, lower pressure plate is subsequently placed into one of the lower spring turns of the coil spring and caused to overlap the second guide means of the second, upper pressure plate with its guide means. The two guide means can be caused to engage one another detachably due to corresponding positive-locking elements.

The threaded spindle can subsequently be passed through the through hole of the axle body and screwed with its threaded section into the threaded pipe. Provisions are made in this connection for the threaded spindle to have a spindle head with a wrench profile, the spindle head having such a diameter that it can be passed fittingly through the through hole of the axle body. A thrust bearing is preferably provided between the spindle head and the pressure plate in order to considerably reduce the frictional forces during the subsequent tensioning operation, i.e., during the rotation of the threaded spindle for tensioning the coil spring. The length of the threaded spindle as well as of the threaded pipe is selected here to be such that the axial spindle does not project axially over the end turn of the coil spring with the coil spring tensioned completely, so that the tensioned coil spring together with the spring vice can be removed as a "set" between the axle body and the body of the motor vehicle.

According to one aspect of the invention, guide plates may be provided as guide means. The first guide means of the first pressure plate extends here from the radially outer edge area of the first pressure plate to the second pressure plate. Furthermore, this first guide means or first guide plate has at least one guide slot, which extends approximately in parallel to the tensioning device. The second guide means is likewise designed as a guide plate and extends from the radially outer edge area of the second pressure plate to the first pressure plate. To detachably connect this second pressure plate with the first pressure plate, this second guide plate is provided with at least one radially outwardly projecting guide element, which engages the guide slot of the first guide plate in a positive-locking and axially adjustable manner. It is easy to imagine that this guide element slides with a small clearance along the guide slot during the tensioning operation and thus forms a means securing the two pressure plates against rotation in relation to one another.

According another aspect of the invention, the guide element or the guide elements of the second guide means may be formed from one or more guide pins, which can be screwed into the free end of the second guide plate. An extremely simple design and consequently an extremely simple possibility of manufacturing the guide elements is achieved due to this design.

According to another aspect of the invention, the guide pins may be designed as fillister head screws, in which case these have a screw head with a wrench profile. The length of the cylindrical section of these fillister head screws is preferably greater than the thickness of the first guide plate with the guide plate mounted rigidly at the second pressure plate. It is thus achieved that the second guide plate with its fillister head screws engaging the guide slots of the first guide plate can be displaced relative to the first guide plate both radially and axially. Relative pivoting movements of the two pressure plates and consequently also of the guide plates relative to one another, which may always occur during the tensioning operation, are thus allowed.

As an alternative, provisions may also be made according to another aspect of the invention for the guide plates to be fastened in such a way that they are mounted pivotably around a pivot axis extending approximately tangentially to the corresponding associated pressure plate. This means that due to this pivotable mounting of the guide plates, a certain compensation of the pivoting movement of the pressure plates is guaranteed during the tensioning operation. The length of the guide pins, which are likewise designed as fillister head screws here and have a screw head, can be adapted in this case to the thickness of the first guide plate with its guide slot. This means that due to this fillister head screw, the first guide plate is accommodated with a small clearance between the screw head and the second guide plate.

As an alternative, the first guide element of the first pressure plate may be designed according to still another aspect of the invention as a guide rod. This guide rod is fastened to the first pressure plate pivotably around a pivot axis extending approximately tangentially to that pressure plate. As a counterpiece to this guide element designed as a guide rod, the second pressure plate has a guide pipe, into which the guide rod of the first pressure plate can be pushed in an axially adjustable manner. This guide pipe is also fastened to the second pressure plate pivotably around a pivot axis extending approximately tangentially to the second pressure plate. Pivoting movements of the pressure plates are likewise compensated here during the tensioning operation due to this pivotable mounting of both the guide rod and the guide pipe. Due to the positive-locking engagement of the guide rod with the guide pipe, the two pressure plates are secured against rotation in relation to one another by this alternative embodiment as well. Furthermore, it is also possible to provide a guide ring, into which the guide rods can be pushed with a small clearance in an axially adjustable manner, instead of the guide pipe.

To make it possible to use this tensioning system for different coil springs to be tensioned as well, provisions may be made according to another aspect of the invention for at least one of the two guide means of one of the pressure plates to be able to be fastened in different, predefined positions in the edge area of the corresponding pressure plate. The relative angular position of the two pressure plates in relation to one another can be set differently due to this design, so that the largest possible number of spring turns can be accommodated between the two pressure plates by turning the pressure plates toward the end of the coil spring to be tensioned as much as possible.

To make sure, especially at the beginning of the tensioning operation, that the pressure plates will not rotate in relation to the coil spring, provisions may be made according to claim 8 to provide one of the two guide elements or even both guide elements with a bushing. A kind of stop lever can be inserted into this bushing, so that depending on the accessibility, the tensioning system is held reliably in its position by means of this stop lever during the actuation of the threaded spindle. In addition, together with a rubber bearing attached in advance to the coil spring, the coil spring can be aligned with a dome-shaped spring mount of the vehicle body due to the stop lever during the installation of a coil spring in a motor vehicle, so that the insertion of the coil spring is made much easier.

According to another aspect of the invention, this bushing may be provided with a hexagon socket, into which the stop lever can be pushed in a stationary manner with a hexagon insert bit in different angular positions. Handling is made much easier by this design during "holding-up" and especially during the alignment of the tensioning system, together with the coil spring, with the spring mount.

Provisions may be made according to claim 10 for the second pressure plate to be mounted pivotably at the threaded pipe of the tensioning device in relation to the threaded pipe. The threaded pipe has two diametrically opposite radial fingers for this purpose, which engage two diametrically opposite hollows of the pressure plate, which define a pivot axis, in the mounted state on the second pressure plate according to another aspect of the invention. The pivot axis extends at an angle of about 0E to about 30E in relation to a plane of symmetry of a recess of the second pressure plate. This recess is used, as this is known from the state of the art, to pass through axially a spring turn accommodated by the pressure plate.

Provisions may be made according to another aspect of the invention for the hollows to be part of a separate bearing ring, which has bearing webs, which project radially outwardly, are located diametrically opposite and extend at right angles to the hollows, wherein the bearing ring can be caused by means of the bearing webs to pivotably engage two depressions of the second bearing plate, which said depressions are arranged in the edge area of a through hole pivotably accommodating the bearing ring, and for the bearing webs to define a second pivot axis extending at right angles to the pivot axis in cooperation with the depressions. The second pressure plate is able due to this embodiment to adapt itself as desired to any changing pitch of a spring turn accommodated during the tensioning operation and during the release operation. Adaptation to the course of the spring turn of a coil spring mounted in the motor vehicle in a curved form or of a coil spring arranged with its end turns diagonally offset in the motor vehicle is also reliably guaranteed, in particular.

According to another aspect of the invention, provisions may be made for a locking means to be provided on the second pressure plate axially on the outside, wherein the locking means can be brought from a neutral position into a locked position, in which the central opening for mounting the threaded pipe with its radial fingers can be closed at least partially. It is ensured by this design that the threaded pipe accommodated with its radial fingers in the opening of the second pressure plate or in the hollows of the opening cannot slip out of the opening and especially out of the hollows when the threaded spindle is attached and screwed in, because the threaded spindle remains securely engaged with the hollows by its radial fingers due to the locking means.

According to another aspect of the invention, the spindle head of the threaded spindle can fittingly engage the thrust bearing. Furthermore, provisions are made according for the thrust bearing to be accommodated in a bearing housing, which has two diametrically opposite, radially outwardly projecting bearing webs. The first pressure plate is mounted pivotably at these bearing webs in relation to the threaded spindle.

According to another aspect of the invention, the first pressure plate has two diametrically opposite hollows, which define a pivot axis, in the area of its opening for mounting at the bearing webs of the bearing housing. These hollows extend at an angle of about 80E to 100E to a plane of symmetry of a recess of the first pressure plate. This recess of this first pressure plate is likewise used, as is already known from the state of the art, to pass through axially the spring turn accommodated by the pressure plate.

The embodiments according to another aspect of the invention are especially advantageous for tensioning coil springs that are inserted in an arc-shaped pattern between the vehicle axle and the body of a motor vehicle or which are accommodated in the motor vehicle with their end turns diagonally or laterally offset. Because of the pivotable mounting, the two pressure plates are able to adapt to such a bent and/or offset course during the tensioning operation and also during the releasing operation during the insertion of the coil spring between the axle body and the body of the motor vehicle.

According to another aspect of the invention, the wrench profile of the spindle head of the threaded spindle is advantageously designed as a hexagon socket. This has the advantage that the spindle head can be made with an extremely small diameter. To actuate the threaded spindle or to drive same, a kind of socket wrench is provided in a hexagon insert bit that can be fittingly inserted into the hexagon socket of the spindle head. Furthermore, this socket wrench has a radially tapered shank section starting from its hexagon insert bit. Damage to the axle body or rubber inserts in the area of the through hole of the axle body is reliably prevented from occurring by this shank section.

Provisions may be made for the drive of the wrench or the socket wrench according to another aspect of the invention that the shank section is provided with a coupling element at its end located opposite the hexagon insert bit. By means of this coupling element, the shank section can be brought into connection with a rotary lever or a so-called "ratchet," adapted to rotate in unison. Extremely simple handling of the spring vice is ensured by this design.

Furthermore, a pretensioning means, by means of which a coil spring to be tensioned can be shortened from its nontensioned length to a pretensioned length, may be provided for the spring vice another aspect of the invention. In this pretensioned length, the spring vice can be caused with its two pressure plates and its tensioning device to engage the coil spring. Such a pretensioning means may be necessary when the corresponding length of the coil spring to be tensioned is extremely great and thus cannot be completely released by means of the spring vice because of a smaller tensioning stroke of the tensioning device. It may also be necessary in certain applications to make the threaded spindle and the threaded pipe relatively short. This is true especially when the distance between the axle body and the body in the mounting area of the spring is short. The threaded spindle cannot be made as long as desired in this case, because it would otherwise be tensioned against the body of the motor vehicle and thus it could cause damage if the coil spring is tensioned completely. On the other hand, the threaded pipe cannot, however, be made as long as desired, either, because the tensioning path of the tensioning device, whose length decreases in a telescopic manner, would not otherwise be sufficient to tension the spring at least approximately completely to remove the spring from the motor vehicle without having to remove the axle. To tension a coil spring, i.e., when mounting a longer coil spring or in case of the "crowded" installation conditions of a coil spring and a correspondingly short design of the threaded spindle and of the threaded pipe, the coil spring is pretensioned by means of the pretensioning means at least to the extent that two spring turns can be grasped in the end areas of the coil spring with the spring vice according to the preceding claims. The coil spring can thus be shortened by means of the spring vice to the extent that the coil spring, tensioned completely, can be inserted between the axle body and the body of a motor vehicle without, for example, the axle body having to be removed.

According to another aspect of the invention, the pretensioning means may have two tensioning plates, at which the coil springs are supported with their two end turns. The axial distance between the two tensioning plates can be changed here by means of a tensioning means. Various designs, for example, tensioning devices, as they are known from spring vices of another design, may be used as the tensioning means here.

Provisions are made another aspect of the invention for the pretensioning means to be designed as a tensioning frame. The first of the two tensioning plates is integrated in the tensioning frame here in a fixed manner. This first tensioning plate is in connection with a support plate in a fixed manner via support rods. This support plate has, in turn, a central pressing device, by means of which the axial distance between the second tensioning plate and the first tensioning plate can be changed.

According to another aspect of the invention, the first tensioning plate has a central centering dome, to which the coil spring can be attached with its end turn. Starting from this centering dome, a radially outwardly directed stop is provided, by which the angular position of the coil spring in relation to its central longitudinal axis or the central longitudinal axis of the pretensioning means in the tensioning frame can be set in a defined manner. Such setting of the angular position may be significant for the later attachment of the spring vice with its two pressure plates, especially when the spring vice with its pressure plates and above all with its two, radially outwardly arranged guide means must be aligned in a special orientation for the installation of the coil spring in a motor vehicle.

According to another aspect of the invention, the second tensioning plate also has a central centering dome for receiving the second end turn of the coil spring to be tensioned. It is ensured by these designs that the coil spring cannot slip out of the pretensioning means during the tensioning of the coil spring.

To facilitate the pressing operation as much as possible, the pressing device may be designed another aspect of the invention as a hydraulic cylinder, to the axially adjustable piston rod of which the second tensioning plate is removably fastened. Due to the removable fastening of the second tensioning plate at the piston rod, the pretensioning means can also be adapted to coil springs with different end turn diameters.

According to another aspect of the invention, a marking means, which can be moved along one of the support rods during the tensioning movement of the first tensioning plate, is arranged at the second axially adjustable tensioning plate. Furthermore, a visible mark, whose axial position defines the pretension of the coil spring at which the spring vice with its pressure plates and its tensioning device is to be attached to the coil spring, is provided on the support rod. The defined pretension of the coil spring for attaching the spring vice can be recognized by the installer in a simple manner due to these marking means.

Furthermore, the stationary first tensioning plate of the tensioning frame may have a central through hole arranged within its centering dome. The hexagon socket of the spindle head of the tensioning device, which is inserted into the coil spring, is freely accessible through this through hole from the outside by means of a wrench. Furthermore, the diameter of this through hole is selected to be such that the threaded spindle with its spindle head can be passed through this through hole and can be caused to engage the threaded pipe.

To align the spindle head in a centered manner in the coil spring during the tensioning or also during the release of the coil spring, a centering sleeve is provided according to another aspect of the invention, which is to be inserted into the through hole of the first tensioning plate in an axially displaceable manner. The length of this centering sleeve is selected to be such that it accommodates the spindle head of the threaded spindle with a small clearance. Because of the axial movement of the spindle head during the tensioning operation due to the spring vice, on the one hand, and due to the pretensioning means, on the other hand, the centering sleeve is displaced to the outside through the through hole of the first tensioning plate during the tensioning. Because of the centered alignment of the spindle head, the hexagon socket of the spindle head is thus always accessible with the wrench in a simple manner, because the hexagon socket is aligned at least approximately centrally with the through hole of the tensioning plate.

According to another aspect of the invention, a positioning tool may be provided for inserting the threaded pipe into the second pressure plate, which engages the spring turn. At one of its ends, this positioning tool has a threaded section, whose axial length is limited by a circumferential stop web. The positioning tool can be screwed with this threaded section into the threaded pipe, so that the threaded pipe can be handled with the positioning tool in a simple manner. To insert the threaded pipe into the second pressure plate, the threaded pipe is axially introduced into the coil spring with the positioning tool, and the threaded pipe with its radial fingers is passed through the opening of the second pressure plate. After rotation by about 90E, the radial fingers of the threaded pipe will then engage the hollows in the area of the opening of the pressure plate. The locking device can now be brought into its locked position, so that the threaded spindle with its radial fingers cannot slip out of the hollows of the pressure plate any longer. Since there is a connection adapted to rotate in unison between the threaded pipe and the pressure plate now, the positioning tool can again be screwed out of the threaded pipe. The first pressure plate is subsequently inserted into the coil spring and the threaded spindle is screwed into the threaded pipe through the first pressure plate, so that the tensioning operation can then start.

Coil springs that are accessible only via an extremely narrow through hole of an axle body of a motor vehicle can be tensioned with the system according to the present invention in a simple and reliable manner. Because of the two guide means provided in the radially outer edge area of the two pressure plates, which brings about the securing of these pressure plates against rotation in relation to one another, it is possible to make the diameter of the tensioning device as small as possible, so that the tensioning device can also be introduced during its use into a coil spring to be tensioned even through extremely narrow through holes of an axle body. Furthermore, precise alignment of this spring vice with its guide means at its pressure plates in relation to the coil spring can be carried out reliably in conjunction with the pretensioning means. Because of the stop directed radially outwardly in the first tensioning plate in the area of the centering dome, the installer has the possibility here to align the coil spring to be tensioned accurately in terms of its angular position in relation to the pretensioning device for the installation. After the pretensioning by a certain tensioning stroke, which can be unambiguously recognized from the marks, the pressure plates can now be inserted into the corresponding spring turns of the coil spring radially from the outside. The two guide means will now engage one another either automatically in a positive-locking and axially displaceable manner, or they can be aligned with one another such that the fillister head screws provided can be screwed into the second guide plate through the guide slot or the guide slots. An axially displaceable, positive-locking and detachable connection is thus achieved between the two guide plates. The two pressure plates with their guide means can be accurately aligned in relation to the coil spring by subsequently aligning the angular position of the two pressure plates in relation to the pretensioning means, which can be recognized by the installer, for example, based on the position of the support rods. Depending on the space conditions at a motor vehicle, this may be necessary in order to make it possible to remove the two pressure plates with their guide means after the insertion of the coil spring. If, for example, the fillister head screws are provided, these must possibly be able to be removed to remove the pressure plates from the coil springs inserted into the motor vehicle, because their accessibility must be guaranteed. Furthermore, the guide means should be preferably positioned on the outside of the curvature of a coil spring inserted into the motor vehicle in the bent shape in order to guarantee secure insertion. This is reliably guaranteed by the pretensioning means with its stop as well as the accurate positioning of the pressure plates in a coil spring pretensioned in the pretensioning means.

An exemplary embodiment of a system for tensioning a coil spring will be explained in greater detail below as an example based on the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
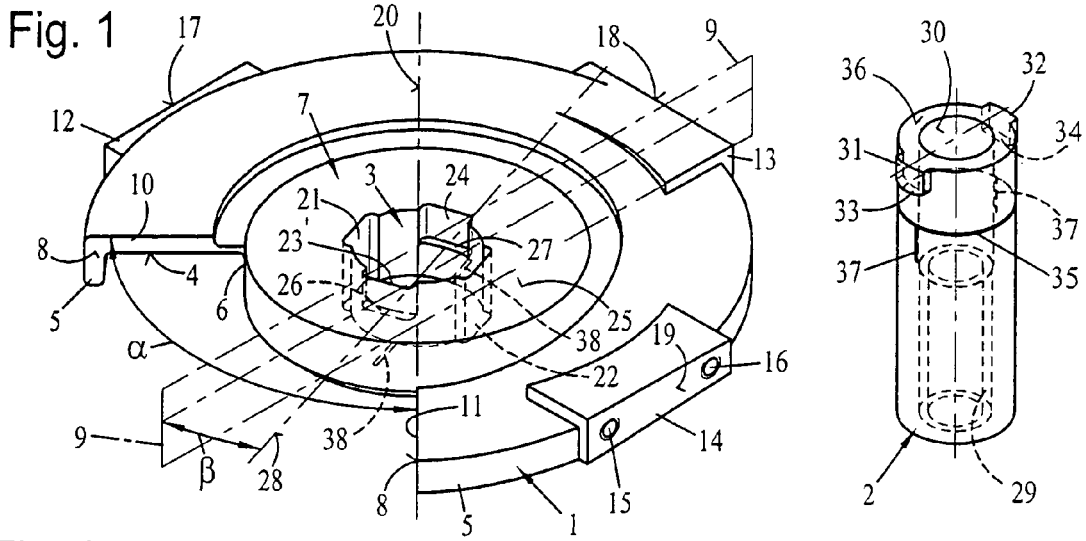
FIG. 1 is a perspective top view of a second pressure plate with threaded pipe.

FIG. 1 shows a perspective top view of a second pressure plate 1 together with a threaded pipe 2. The second pressure plate 1 has an approximately circular base and is provided with a central opening 3 in its center. This second pressure plate 1 forms a tensioning surface 4, which is limited by an edge web 5 in its radially outer edge area, for receiving a spring turn of a coil spring to be tensioned. The tensioning surface 4 is radially limited in its radially inner edge area by an inner edge web 6, which is formed by a central support disk 7.

As can be recognized from FIG. 1, the central opening 3 is located within this support disk 7, which is arranged concentrically in the pressure plate 1. It can also be recognized from FIG. 1 that the outer edge area of the pressure plate 1, which edge area forms the tensioning surface 4, has a circumferential pitch. The tensioning surface 4 is interrupted by a recess 8, which extends over an angle " of about 90E in the circumferential direction. This recess is used to pass through axially a spring turn to be accommodated of a coil spring to be tensioned, as this is already sufficiently known from the state of the art. This recess 8 defines a plane of symmetry 9 in relation to which the two end edges 10 and 11 of the tensioning surface 4 are arranged symmetrically. Furthermore, the second pressure plate 1 is provided in its radially outer edge area, symmetrically to the plane of symmetry 9, with a total of three mounting blocks 12, 13 and 14 in this exemplary embodiment, which are distributed uniformly on the circumference of the second pressure plate 1, offset at right angles in relation to one another. Each of these mounting blocks 12, 13 and 14 is provided with two threaded holes, which are designated by the reference numbers 15 and 16 for the mounting block 14. These mounting blocks 12, 13 and 14 are used to optionally mount a guide means, as this will be explained in greater detail below. Each of the mounting blocks has a mounting surface 17, 18, 19, which extend approximately tangentially to the pressure plate 1 and at the same time in parallel to the central longitudinal axis 20 of the second pressure plate 1.

Furthermore, it can be recognized from FIG. 1 that the central opening 3, which is arranged concentrically with the central longitudinal axis 20 of the pressure plate 1, has two diametrically opposite, axially continuous radial expansions 21 and 22. Furthermore, the opening 3 is provided with two radial hollows 23 and 24, which extend, starting from the outer surface 25 of the support disk 7, up to about half the axial length of the opening 3. These radial hollows 23 and 24 form a support surface 26 and 27, respectively, whose function will be explained in greater detail below. The two hollows 23 and 24 are likewise arranged diametrically opposite in relation to the central longitudinal axis 20 of the second pressure plate 1 and are arranged approximately at right angles to the two radial expansions 21 and 22 of the central opening 3. These two hollows 23 and 24 with their support surfaces 26 and 27 define a pivot axis 28, which is arranged extending at an angle $ of about 15E in relation to the plane of symmetry 9 of the recess 8 of the pressure plate 1 in this exemplary embodiment. In the circumferential area of the two hollows 23, 24, the support disk 7 has two radially outwardly extending line marks on the outside, starting from the opening 3, which mark the circumferential position of the hollows 23 and 24 on the underside.

As is apparent from FIG. 1, the threaded pipe 2 has a cylindrical design and has an internal thread 29, which is indicated by broken line in FIG. 1. This internal thread 29 is joined toward the upper end of the threaded pipe 2 by a radially expanded hole section 30, so that a threaded spindle, which can be screwed into the internal thread 29, can be screwed axially through the threaded pipe 2.

Furthermore, the threaded pipe 2 has two radially projecting radial fingers 31 and 32 at its upper end, with which radial fingers the threaded pipe 2 can be caused to engage the two hollows 23 and 24 of the second pressure plate 1. Each of the radial fingers 31 and 32 has a support surface 33 and 34, respectively, which extend in an arc-shaped pattern and by means of which the threaded pipe 2 is pivotably supported on the support surfaces 26 and 27 of the two hollows 23 and 24 of the pressure plate 1. The two radial fingers 31 and 32 are likewise located diametrically opposite each other here. The circumferential length of the two radial fingers 31 and 32 is smaller than the circumferential length of the respective associated hollow 23 and 24, so that the threaded pipe 2 can perform a certain pivoting movement around the pivot axis 28 in the opening 3 of the pressure plate 1. At the same time, the opening 3 likewise has an approximately oval base and it has a larger diameter in the area of its two radial expansions 21 and 22, so that the pivoting movement is made possible.

In its upper end area, in which the two radial fingers 31 and 32 are arranged, the threaded pipe 2 has a circumferential ring mark 35, whose distance from the upper front surface 36 of the threaded pipe 2 approximately corresponds to the thickness of the support disk 7 of the second pressure plate 1. Due to this ring mark 35, the installer is able to recognize that the two radial fingers 31 and 32 correctly engage the two hollows 23 and 24 of the second pressure plate 1. The ring mark 35 is recognizable in this case on the underside under the support disk 7 of the pressure plate 1, because the ring mark 35 is located under the support disk 7 because of its axially spaced location from the upper front surface 36 of the threaded pipe 2.

Furthermore, two line marks 37, from which the position of the two radial fingers 31 and 32 at the threaded pipe 2 can be recognized, are provided in the circumferential area of the two radial fingers 31 and 32 starting from the ring marks 35. To insert the threaded pipe 2 correctly, the threaded pipe with its radial fingers 31 and 32 is aligned with the two radial expansions 21 and 22 of the second pressure plate 1 and passed from below through the second pressure plate 1 after the pressure plate 1 had been inserted into a coil spring. After rotation by about 90E, the two radial fingers 31 and 32 will overlap the hollows 23 and 24 of the second pressure plate 1. Since, as is apparent from FIG. 1, the two line marks 37 extend downwardly starting from the ring mark 35 in the direction of the internal thread 29 and opposite the upper front surface 36, this correct angular position of the radial fingers 31 and 32 for their engaging the hollows 23 and 24 can be recognized by the installer from the underside of the second pressure plate 1. The installer can thus reliably recognize that the threaded pipe 2 with its radial fingers 31 and 32 can be correctly inserted into the two hollows 23 and 24 in this position.

This upper, second pressure plate 1 is likewise provided for this purpose with two radially extending line marks 38 on the underside at the support disk 7, starting from the opening 3, and the angular position of these line marks 38 corresponds to the angular position of the two hollows 23 and 24. The installer will thus recognize that the threaded pipe 2 with its radial fingers 31 and 32 is in the correct angular alignment in relation to the two hollows 23 and 24 if the line marks 37 and 38 overlap the two line marks 39 of the second pressure plate 1. The threaded pipe 2 is to be withdrawn axially downwardly in this position, so that the two radial fingers 31 and 32 can be caused to engage the two hollows 23 and 24 in the correct position.

Figure 15:
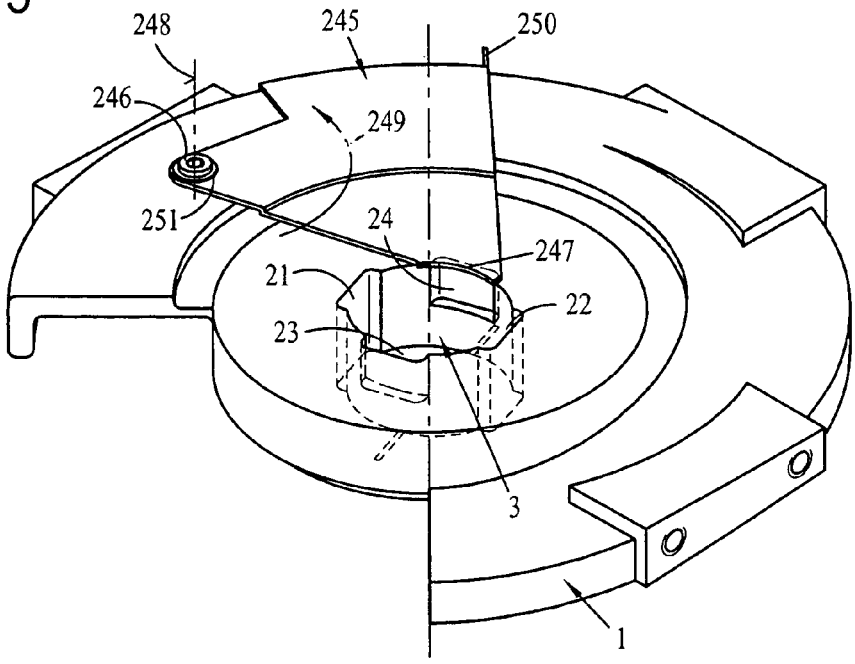
FIG. 15 is the second, upper pressure plate from FIG. 1 with a locking means arranged additionally.

To secure the threaded pipe in this inserted position in the opening 3 of the pressure plate 1, a locking means 245 may be provided, as it is shown as an example in FIG. 15. As is shown as an example in FIG. 15, this locking means may comprise a safety plate 245, which is pivotably fastened on the top side on the pressure plate 1 by means of a mounting screw 246. A safety plate, which can be radially displaced in relation to the pressure plate 1 and which is accommodated radially displaceably on the top side on the pressure plate 1 by means of two guide rails (not shown in the drawing), is also imaginable instead of such a pivotable fastening. In the pivoted position shown in FIG. 15, the safety plate 245 is in a locked position, in which the safety plate 245 closes at least the hollow 24 in the upward direction with a securing section 247. Consequently, a threaded pipe 2, which is correctly inserted into the hollows 23, 24 with its radial fingers 31 and 32, as is apparent from FIG. 4, cannot slip out of the hollows 23 and 24 in this locked position. The operational safety of the spring vice 120 according to the present invention is thus considerably increased, because the threaded pipe 2 with its radial fingers cannot be caused to accidentally disengage the hollows 23 and 24. To make it possible to remove the threaded pipe 2 from the pressure plate 1, the safety plate can be pivoted from its locked position shown into a neutral position in the direction of the arrow 249 around the screw axis 248 of the mounting screw 246 until the securing section 247 completely releases the opening 3 together with the hollow 24. To facilitate handling, the safety plate 245 has a radially outwardly projecting actuating section 250 in this exemplary embodiment, which also projects radially outwardly over the pressure plate 1. The actuating section 250 can thus also be reached reliably during the insertion of the pressure plate 1 on the motor vehicle, so that the safety plate can be adjusted in a simple manner from its neutral position into the locked position shown in FIG. 15 and back again. To secure the safety plate 245 in its respective position, this safety plate can be secured in a frictionally engaged manner by means of the mounting screw 246 and a spring tensioning ring 251. As an alternative or in addition hereto, it is, however, also possible to provide detents at the safety plate 245 and depressions arranged on the top side of the pressure plate 1 in corresponding positions, which can be caused to detachably engage one another alternatingly in one of the positions of the safety plate 245 (not shown in the drawing).

Figure 2:
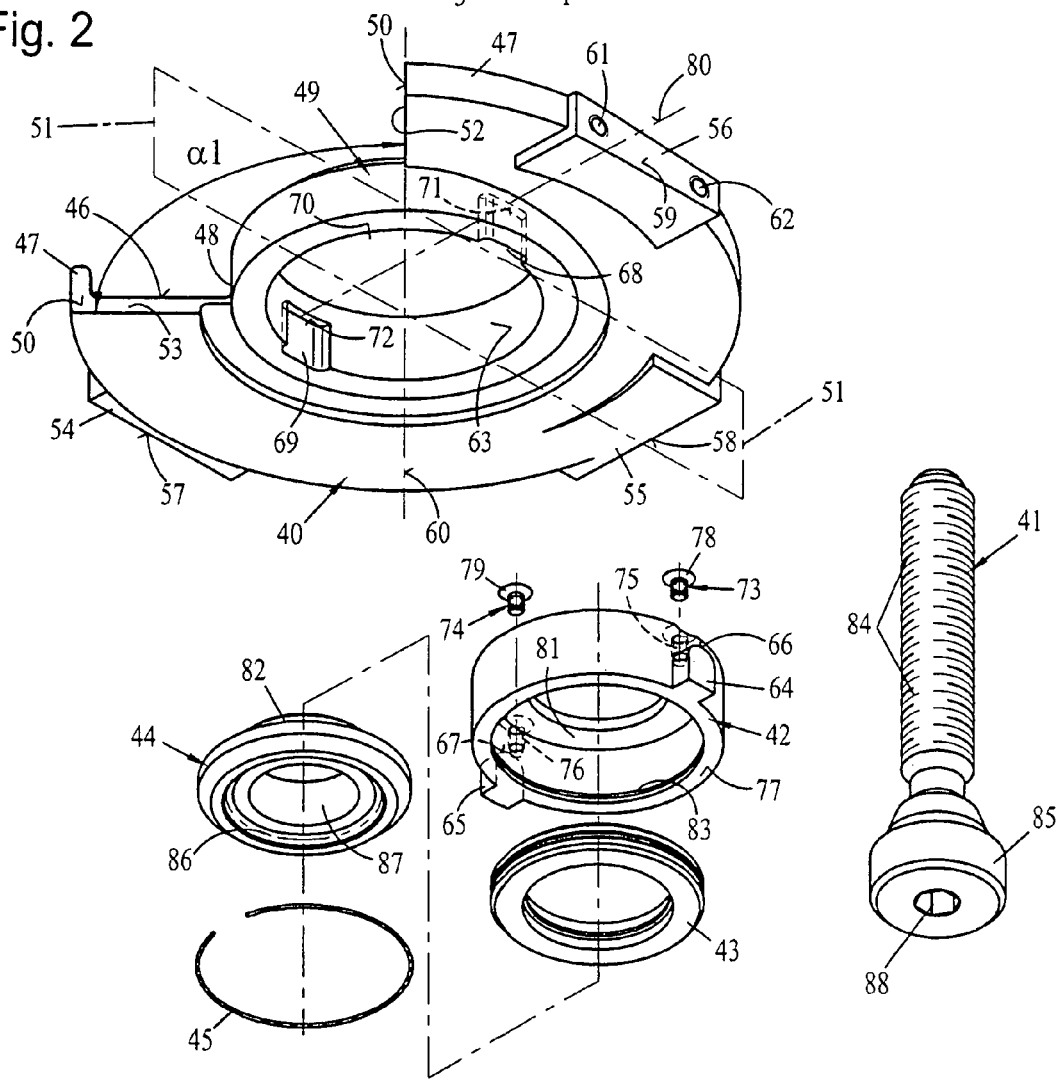
FIG. 2 is a perspective bottom view of a first pressure plate with a threaded spindle, a bearing housing, a thrust bearing, a support ring and a retaining ring.

FIG. 2 shows a bottom view of a first pressure plate 40 together with a threaded spindle 41 as well as a bearing housing 42, a thrust bearing 43, a support ring 44 and a retaining ring 45. The first pressure plate 40 likewise has a circular base and forms a tensioning surface 46, which is used to receive a spring turn of a coil spring to be tensioned. This tensioning surface 46 has a circumferential pitch and is likewise limited by a first edge web 47 in the radially outer area and by a second edge web 48 of a central support disk 49 in the radially inner area. The support surface has a recess 50, which extends over a circumferential angle "1 of likewise about 90E. This recess 50 is used to pass through axially a spring turn to be accommodated of a coil spring, as this is known from the state of the art. The recess 50 likewise defines a plane of symmetry 51, in relation to which the two end edges 52 and 53 of the recess 50 are arranged symmetrically.

This exemplary embodiment of the first pressure plate 40 is also provided in its radially outer edge area with a total of three mounting blocks 54, 55 and 56, which extend with their respective outer mounting surfaces 57, 58 and 59 tangentially to the first pressure plate 40 as well as in parallel to the central longitudinal axis 60 of the pressure plate 40. Each of the mounting blocks 54, 55 and 56 has two threaded holes 61, of which only the two threaded holes 61 and 62 of the mounting block 56 can be recognized in FIG. 2. These mounting blocks 54, 55 and 56 are also used to alternately mount a guide means, as it will be explained in greater detail below. Concerning the features of the first pressure plate 40 that have been described so far, this pressure plate has a design identical to that of the second pressure plate 1 in FIG. 1. It shall be noted here that the mounting blocks 12, 13 and 14 as well as 54, 55 and 56 of the second pressure plate 1 as well as of the first pressure plate 40 may also be arranged in different angular positions and even in different numbers at the two pressure plates 1 and 40. The selection of the number as well as of the arrangement in the circumferential area of the respective pressure plate 1 or 40 depends essentially on the field of application and the course of a coil spring mounted in a vehicle.

Furthermore, the first pressure plate 40 likewise has a central opening 63, which has a considerably larger diameter than the central opening 3 of the second pressure plate 1. This central opening 63 of the first pressure plate 40 is used to pivotably receive the bearing housing 42. To support the bearing housing 42 axially, the bearing housing is provided with two diametrically opposite, radially outwardly projecting bearing webs 64 and 65. Each of the bearing webs 64 and 65 has a support surface 66 and 67, respectively, which extend in an arc-shaped pattern and via which the bearing housing 42 is pivotably supported axially in two hollows 68 and 69, respectively, of the opening 63 of the first support plate 40. As can be recognized from FIG. 2, these hollows 68 and 69 form radial expansions of the opening 63, which extend from the outer surface 70 of the support disk 49 in the axial direction of the central longitudinal axis 60 over two thirds of the thickness of the support disk 49. Each of the hollows 68 and 69 forms a respective support surface 71 and 72, on which the two support surfaces 66 and 67 of the bearing webs 64 and 65 of the bearing housing 42 are axially supported in the mounted state.

Two securing screws 73, 74, which can be screwed into an internal thread 75 and 76, respectively, of the bearing housing 42, are provided to secure the bearing housing 42 in the opening 63 of the first pressure plate 40. These two internal threads 75 and 76 are arranged axially opposite the two bearing webs 64 and 65 in the radially outer edge area of the upper front surface 77 of the bearing housing 42, so that the securing screws 73 and 74 partially project radially over the bearing housing with their respective screw heads 78 and 79. The bearing housing 42 is thus held by the securing screws 73 and 74 with a clearance in the opening 63 of the first pressure plate 40. The dimensions of the bearing webs 64 and 65 as well as of the hollows 68 and 69 are coordinated with one another such that the bearing housing 42 can be pivoted in the hollows 68 and 69 around a pivot axis 80 defined by the two support surfaces 71 and 72. This pivot axis 80 extends at right angles to the plane of symmetry 51 of the recess 50 of the tensioning surface 46 of the first pressure plate 40 in this exemplary embodiment. Furthermore, the opening 63 also has an oval shape and has a larger diameter in the area at right angles to its two hollows 68 and 69 than in the area of the hollows 68 and 69, as a result of which the pivotability of the bearing housing 42 in the opening 63 is guaranteed.

Furthermore, with its two bearing webs 64 and 65 located axially opposite each other, the bearing housing forms a radially inwardly directed support ring 81, at which the thrust bearing 43 inserted into the bearing housing 42 is supported axially during operation. Furthermore, the support ring 44 can be inserted into the mounted thrust bearing 43, and the support ring has a cylindrical centering attachment 82 for this purpose, which is accommodated in a centered manner by the thrust bearing 43 in the mounted state.

To secure the support ring 44 together with the thrust bearing 43 in the bearing housing 42, the retaining ring 45 is provided, which can correspondingly be inserted into a circumferential radial groove 83 of the bearing housing 42. The bearing housing 42 is designed for this purpose as a mounting cylinder, and the radial groove 83 is arranged on the inner wall of the bearing housing 42.

Furthermore, FIG. 2 shows the threaded spindle 41, which has a threaded section 84 for being screwed into the threaded pipe 2 shown in FIG. 1. This threaded section 84 is joined by a spindle head 85, which expands radially and can be fittingly inserted into a central hollow 86 of the support ring 44. The axial length of the spindle head is selected here to be such that the spindle head axially projects over the support ring 44 by at least a few mm in the mounted state. To pass through the threaded section 84 of the threaded spindle 41 axially, this support ring 44 has a corresponding through hole 87, which is concentrically surrounded by the hollow 86. Furthermore, it can be recognized from FIG. 2 that the spindle head 85 has a wrench profile in the form of a hexagon socket 88, which is used to rotatingly drive the threaded spindle 41 by means of a correspondingly fitting wrench.

Figure 3:
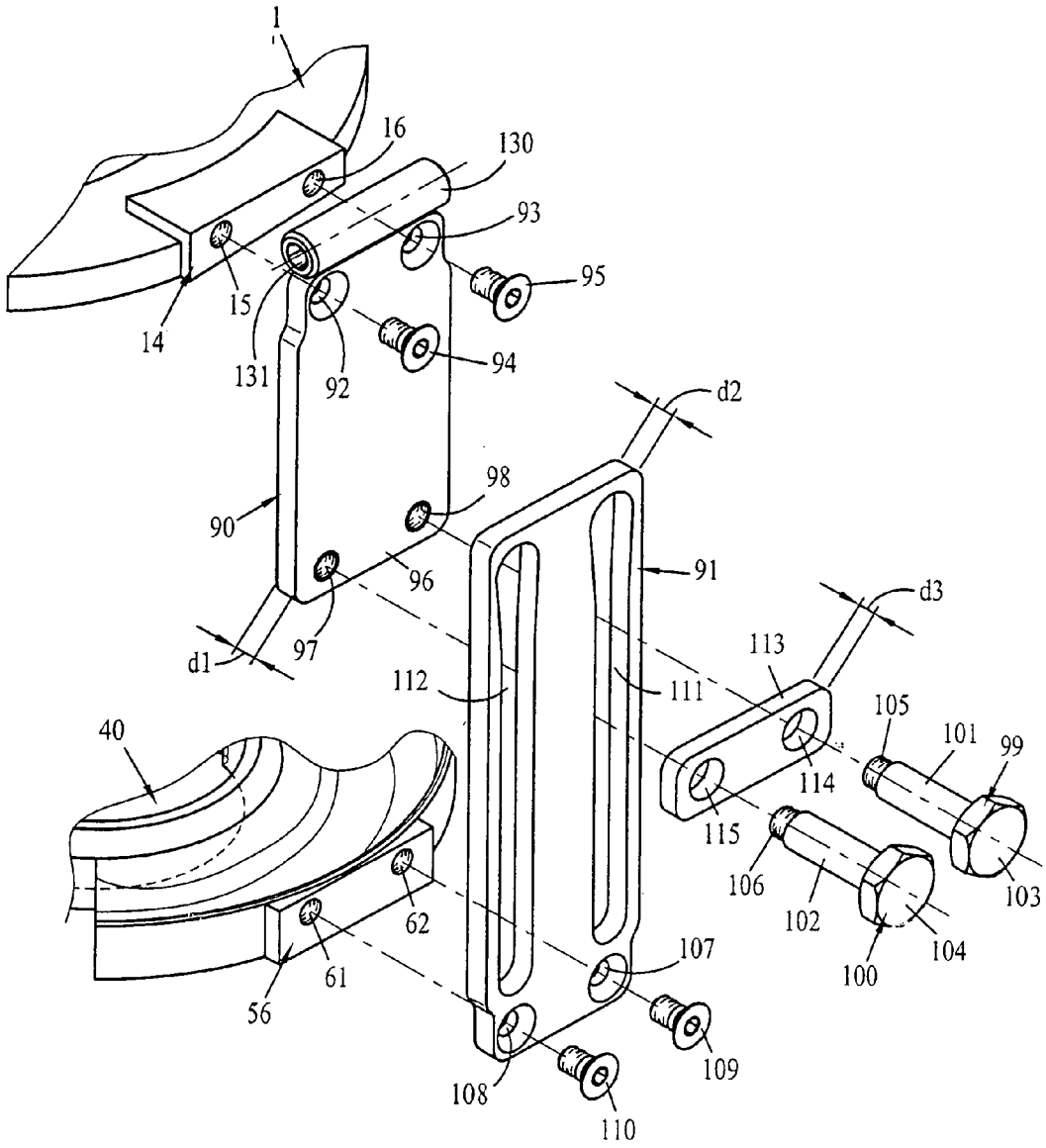
FIG. 3 is a partial perspective view of two guide means with the two pressure plates.

FIG. 3 shows a perspective exploded view of a first guide means as well as of a second guide means, which are designed as a guide plate 90 and 91, respectively. At its top end, the guide plate 90 has two through holes 92 and 93, through which a respective mounting screw 94 and 95 can be passed. As is shown as an example in FIG. 4, this second guide plate 90 can be mounted in a fixed manner, for example, at the mounting block 14 of the second pressure plate 1 by means of these mounting screws 94 and 95. In its end area 96 located axially opposite the two through holes 92 and 93, the second guide plate 90 has two internal threads 97 and 98, into which a guide pin each, designed as a fillister head screw 99, 100, can be screwed removably.

These fillister head screws 99, 100 have a cylindrical guide shank 101, 102, respectively, as well as a radially enlarged screw head 103 and 104, respectively. A threaded section 105, 106 each, whose axial lengths approximately correspond to the thickness d1 of the guide plate 90, is provided at the end of each guide shank 101, 102.

The first guide plate 91 likewise has in its lower end area two through holes 107 and 108, through which two mounting screws 109 and 110 can likewise be passed. This first guide plate 91 can be fastened in a fixed manner by means of these mounting screws 109 and 110, for example at the mounting block 56 of the first pressure plate 40. The two mounting screws 109 and 110 are screwed for this purpose into one of the threaded holes 61 and 62, respectively.

The first guide plate 91 is provided, furthermore, with two guide slots 111, 112, which extend in parallel to one another and extend approximately over the entire length of the first guide plate 91, as this is apparent from FIG. 3. The first guide plate 91 can be connected axially displaceably and detachably with the second guide plate 90 by means of these guide slots 111 and 112 and the two fillister head screws 99 and 100. The fillister head screws 109 and 110 are passed for this purpose through one of the guide slots 111 and 112 and screwed into the correspondingly associated internal thread 97 and 98, respectively, of the second guide plate 90.

To stabilize the two fillister head screws 99, 100 against one another, especially if the first guide plate 91 with its guide slots 111, 112 is arranged in the vicinity of the screw heads 103 and 104, a support plate 113 is provided, which has two corresponding through holes 114 and 115, through which the two fillister head screws 99, 100 with their respective guide shanks 101 and 102 can be fittingly passed.

In the mounted state, the two guide means 90, 91 bring about a connection of the two pressure plates 1 and 40 in such a way that they are adapted to rotate in unison. These guide means 90, 91 are displaceable axially in relation to one another during use approximately in parallel to a coil spring to be tensioned because of the guide slots 111 and 112 of the first guide plate 91. The axial length of the two guide slots 111 and 112 corresponds at least to the tensioning stroke of the tensioning device formed from the threaded spindle 41 and the threaded pipe 2.

Figure 4:
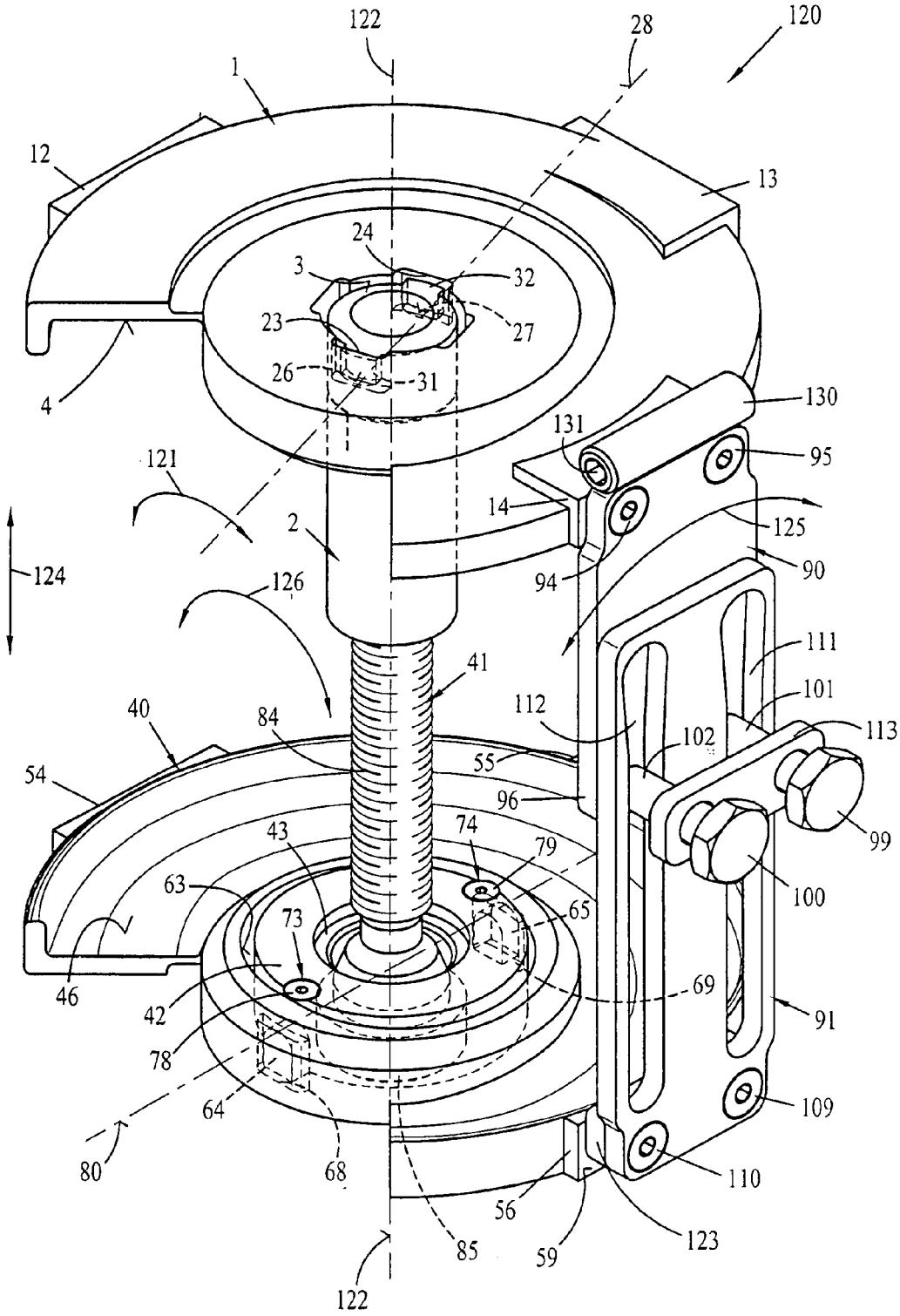
FIG. 4 is a perspective view of a completely mounted spring vice with guide means.

FIG. 4 shows a perspective view of a completely mounted spring vice 120. It can be recognized that the guide pipe 2 with its two radial fingers 31 and 32 engages the two radial hollows 23 and 24. The circumferential length of the radial fingers 31 and 32 is shorter than the circumferential length of the two hollows 23 and 24, so that the second pressure plate 1 has an at least limited pivotability around the pivot axis 28 defined by the hollows 23 and 24 in the direction of the double arrow 121. The safety plate 245 from FIG. 15 may also be provided here, but this is not shown for the sake of clarity. However, it is easy to imagine that the threaded pipe 2 cannot be pushed axially out of the opening 3 if the safety plate from FIG. 15 is arranged in the locked position shown there on the top side of the second pressure plate 1.

The second guide means or guide plate 90 is mounted in a fixed manner at the mounting block 14 by means of the mounting screws 94 and 95. It shall be noted in this connection that depending on the field of application, this second guide plate 90 may also be mounted in a fixed manner at one of the other two mounting blocks 12 or 13 provided. This also depends ultimately on how the coil spring to be removed from the vehicle extends between the axle body and the body. The pivot axis 28 provided is correspondingly also to be aligned in relation to the first, lower pressure plate 40 in order to take into account, for example, a coil spring that is mounted in a curved shape.

Furthermore, it can be recognized from FIG. 4 that the first guide plate 91 is mounted in a fixed manner at the mounting block 56 of the first pressure plate 40 by means of its mounting screws 109 and 110. In the starting position shown in FIG. 4, the first guide plate 91 is radially flatly in contact on the outside with the second guide plate 90, so that a distance plate 123, which is arranged between the mounting surface 59 of the mounting block 56 and the first guide plate 91, is provided to compensate this radially greater distance of the first guide plate 91 relative to the second guide plate 90 in relation to the central longitudinal axis 122 of the spring vice 120 in this exemplary embodiment.

As can also be recognized from FIG. 4, the two fillister head screws 99 and 100 are screwed into the lower end 96 of the second guide plate 90 in a fixed manner. These fillister head screws 99, 100 pass through the two guide slots 111, 112 with their guide shanks 101 and 102 radially from the inside to the outside. The support plate 113 is placed on these two guide shanks 101 and 102, so that the two fillister head screws 99 and 100 are stabilized especially in the area of their screw heads 103 and 104.

Because of this guiding of the two fillister head screws 99 and 100 in the guide slots 111 and 112, which guide is adjustable axially in the direction of the double arrow 124, adjustability of the two pressure plates 1 and 40 is made possible in the axial direction, on the one hand, and securing of these two pressure plates 1 and 40 against rotation in relation to one another is brought about at the same time. A relative pivotability of the two pressure plates 1 and 40, for example, around the double arrow 125, is also possible because of the slot guiding without the securing against rotation being eliminated.

Such a pivotability in the direction of the double arrow 125 may be necessary when a coil spring to be tensioned is clamped in the bent state between the axle body and the body of a vehicle. In addition, the two pressure plates 1 and 40 perform a pivoting movement, at least within certain limits, during the tensioning operation, and this pivoting movement remains guaranteed without collision by the slot guiding of the two guide plates 90 and 91.

As is also apparent from FIG. 4, the guide shanks 101 and 102 of the two fillister head screws 99 and 100 have a considerably greater length than the sum of the thickness d2 (FIG. 3) of the first guide plate 91 and d3 (FIG. 3) of the support plate 113. It is guaranteed by this design that the two guide plates 90 and 91 can also perform a pivoting movement in the direction of the double arrow 126, because there is a sufficient clearance between the screw heads 103 and 104 of the two fillister head screws 99 and 100 and the second guide plate 90.

It is also apparent from FIG. 4 that the bearing housing 42 is inserted into the opening 63 of the second pressure plate 40. The two bearing webs 64 and 65 now engage the correspondingly associated hollows 68 and 69 of the opening 63 of the first pressure plate 40. It can be recognized here as well that the circumferential length of the two bearing webs 64 and 65 is shorter than the corresponding circumferential length of the associated hollow 68 and 69, respectively, so that the bearing housing 42 is pivotable relative to the first pressure plate 40 around the pivot axis 80 defined by the two hollows 68 and 69.

It can be recognized here that the two pivot axes 28 and 80 do not extend in parallel to one another in this arrangement of the two pressure plates 1 and 40. The alignment of the two pivot axes 80 and 28 in relation to one another depends here on the particular conditions of use and can be set by selecting the mounting blocks 12, 13, 14 and 54, 55 and 56 for mounting the guide means 90 and 91. This means that the angular position of the two pressure plates 1 and 40 can be adapted to the course of a coil spring clamped in a motor vehicle depending on the optional mounting of the two guide plates 90 and 91 at one of the respective mounting blocks 12, 13, 14 and 54, 55 and 56 provided.

Furthermore, it can be recognized from FIG. 4 that the two securing screws 73 and 74, which radially project outwardly over the bearing housing 42 with their respective screw heads 78 and 79, are screwed into the bearing housing. The bearing housing 42 is held captively due to this design in the opening 63 of the pressure plate 40, and its pivotability is preserved, because the axial length or height of the bearing housing 42 is at least minimally greater than the axial length of the opening 63 of the support disk 49 of the first pressure plate 40, i.e., the axial depths of the hollows 68, 69 as well as the axial lengths of the two bearing webs 64, 65 as well as the axial length of the bearing housing 42 are coordinated with one another such that a minimum axial distance of about 1 mm to 3 mm is always present between the radially outwardly projecting screw heads 78, 79 and the support disk 49.

Furthermore, it can be recognized from FIG. 4 that the threaded spindle 41 with its spindle head 85 is inserted into the thrust bearing 43 of the bearing housing 42. Starting from its spindle head 85, the threaded spindle 41 passes through the bearing housing 42 with its thrust bearing 43 in the direction of the threaded pipe 2 and is screwed with its threaded section 84 into the internal thread 29 (FIG. 1) of the threaded pipe 2, which said internal thread cannot be recognized in FIG. 4. It is easy to imagine that by actuating the threaded spindle 41 via its hexagon socket 88 shown in FIG. 2, the distance between the two pressure plates 1 and 40 can be changed in a variable manner for tensioning a coil spring. As this is sufficiently known from the state of the art, the coil spring is accommodated between the two tensioning surfaces 4 and 46 of the two pressure plates 1 and 40.

It can also be recognized from FIGS. 3 and 4 that above the two mounting screws 94 and 95 and above its two through holes 92 and 93, the second guide plate 90 has a bushing 130, which, extending at right angles to the guide plate 90, is arranged in a fixed manner on the upper front side of the guide plate. This bushing 130 may be welded to the guide plate 90. In this exemplary embodiment, this bushing 130 has a through hexagon socket 131, into which a stop lever can be inserted. The second pressure plate 1 and, via the two guide plates 90 and 91, also the first pressure plate 40 can be fixed by means of this stop lever, which will be described in greater detail in FIG. 9, in a defined angular position in the state in which it is attached to a coil spring. As a result, the operation of the spring vice 120 is made easier for the installer. Furthermore, the spring vice 120 can be aligned with the spring mount of the vehicle body in a simple manner by means of the stop lever together with a coil spring clamped in the spring vice, especially during the installation of the coil spring between the axle body and the body of a motor vehicle.

Figure 5:
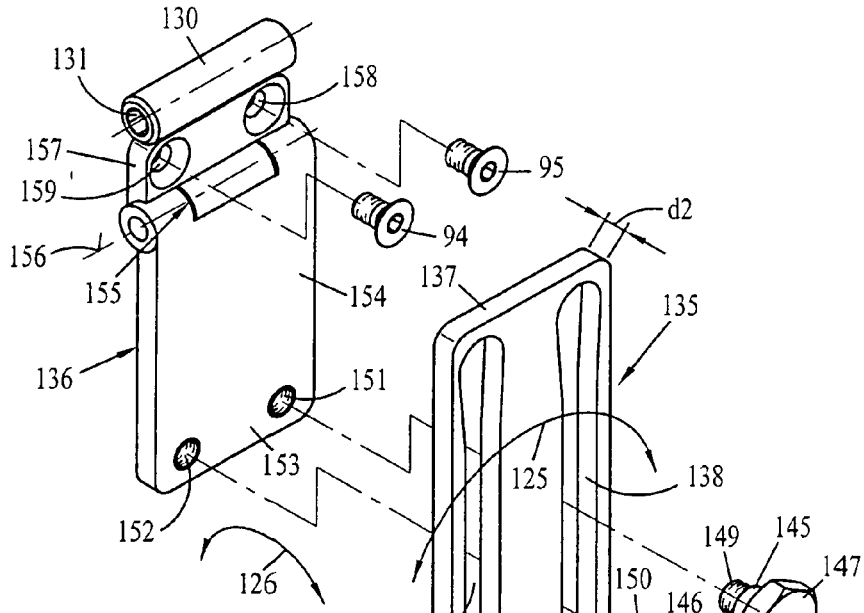
FIG. 5 is a perspective view of a first alternative embodiment of two guide means.

FIG. 5 shows another exemplary embodiment of two guide elements 135 and 136, which have a design similar to that of the two guide elements 90 and 91. Thus, the first guide element 135 likewise has a guide plate 137, which is provided with two guide slots 138 and 139 extending along this guide plate 137. The guide plate 137 is in connection with a mounting plate 141 via a pivot bearing 140 and is mounted pivotably around the pivot axis 142 of the pivot bearing 140. Furthermore, two fillister head screws 143 and 144 are provided here as well, which have a respective cylindrical shank section 145 and 146. These fillister head screws 143 and 144 are likewise provided with a respective screw head 147 and 148 designed as a hexagon and have a respective threaded section 149 and 150 at the end of the respective shank section 145 and 146 located opposite the respective screw head 147 and 148. The two fillister head screws 143 and 144 can be screwed with these threaded sections 149 and 150 into a respective associated internal thread 151 and 152 of the second guide element 136 in a firmly seated manner. These internal threads 151 and 152 are arranged, just as in the case of the guide plate 90 in the exemplary embodiment according to FIG. 3, in the lower end area 153 of a guide plate 154 of the second guide element 136. This guide plate 154 is likewise mounted pivotably by means of a pivot bearing 155 around a pivot axis 156 of the pivot bearing 155 at a mounting plate 157 of the second guide element 136.

For mounting at the respective mounting block 12, 13 or 14 selected, the mounting plate 157 has two through holes 158 and 159, through which two mounting screws 94 and 95 can be correspondingly passed and can be screwed, for example, into the threaded holes 15 and 16 of the mounting block 14, which are shown as an example in FIG. 1. The entire guide element 136 is thus held in a firmly seated manner at the second pressure plate 1, and the pivot axis 156 extends approximately tangentially to the pressure plate 1 in this state. Pivoting movements of the pressure plate 1 that occur during the tensioning operation are compensated by this pivot bearing 155.

In a similar manner, the first guide element 135 also has two through holes 160 and 161 in its mounting plate 141, by means of which through holes the guide element 135 or the mounting plate 141 thereof can be fastened to one of the mounting blocks 54, 55 or 56 as desired. Two mounting screws 109 and 110, which can be screwed into the correspondingly associated threaded holes, as they are shown as an example for the mounting block 56 in FIG. 2, are likewise provided for this purpose. The pivot axis 142 extends essentially tangentially to the pressure plate 40 in this case as well in the state in which the guide means 135 is mounted on the first pressure plate 40.

The second guide element 136 is also provided on its top side with the bushing 131. This bushing 130 is welded in a fixed manner on the upper front surface of the mounting plate 157 in this case as well and is used to lock the mounting plate 157 and consequently also the second pressure plate 1 by means of a corresponding stop lever, which can be inserted fittingly into this hexagon socket 131.

The length of the two shank sections 145 and 146 of the fillister head screws 143 and 144 is selected to be greater only minimally than the thickness d2 of the guide plate 137 in this exemplary embodiment of the guide elements 135 and 136, so that the guide plate 137 is guided axially displaceably along the guide plate 154 with a small clearance by means of these fillister head screws 143 and 144 in the mounted state. Because of the slot guiding, a certain pivotability in the direction of the arrow 125 of the two guide elements 135 and 136 in relation to be another is possible in this case as well, so that the two pressure plates 1 and 40 are likewise pivotable in relation to one another within certain limits during the tensioning operation and the changing pitch of the coil spring can thus be compensated during a tensioning operation.

The pivotability in the direction of the double arrow 126 is made possible by the two pivot bearings 140 and 155, and securing of the two pressure plates 1 and 40 against rotation in relation to one another is reliably guaranteed. Because of these two pivot bearings 140 and 155, an additional distance plate is not necessary for mounting especially the mounting plate 157 on one of the mounting blocks 54, 55 or 56 of the first pressure plate 40, so that the two mounting plates 141 and 157 can be arranged at the same radial distance from the central longitudinal axis 122 (FIG. 4).

Figure 6:
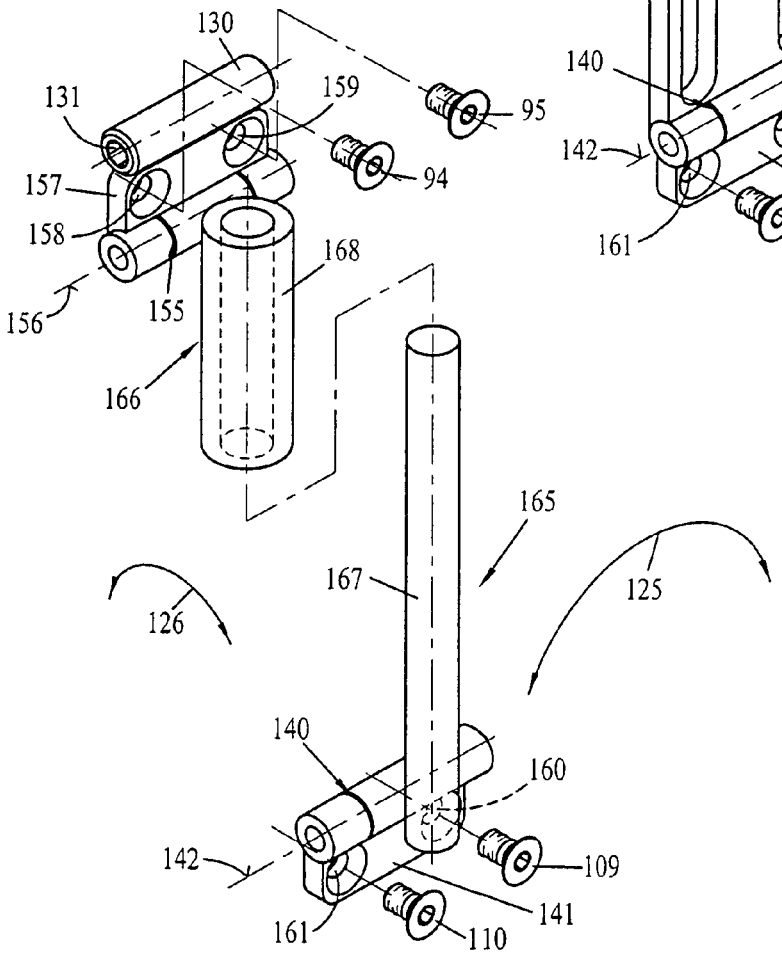
FIG. 6 is a perspective view of a second alternative embodiment of two guide means.

FIG. 6 shows as an example a third exemplary embodiment of two guide elements 165 and 166. Both guide elements have a respective mounting plate 141 and 157 in this case as well, which have the same design as in the exemplary embodiment according to FIG. 5. Thus, the mounting plate 141 has two through holes 160 and 161 in this case as well, which make it possible to fasten the guide element 165 on the first pressure plate 40 by means of the two mounting screws 109 and 110. Furthermore, the guide element 165 also has the pivot bearing 140. The mounting plate 157 is provided with the two through holes 158 and 159, which are provided for mounting on the second pressure plate 1 by means of the two mounting screws 94 and 95. The bushing 130 with its hexagon socket 131 is likewise provided in the upper end area of the mounting plate 157. Instead of a guide plate 137 as in the exemplary embodiment according to FIG. 5, the first guide element 165 has a guide rod 167, which is connected with the mounting plate 141 pivotably around the pivot axis 142 of the pivot bearing 140. For connection with the second guide element 166, the latter is in turn provided with a guide pipe 168, into which the guide rod 167 can be screwed in an axially adjustable manner with a small clearance. The two guide elements 165 and 166 also form a means securing the two pressure plates 1 and 40 against rotation in relation to one another in the mounted state, and a certain pivotability is likewise guaranteed in these pressure plates in relation to one another because of the pivot bearings 155 and 140 provided.

If the guide pipe 168 is relatively short, e.g., if it is designed as a guide ring (not explicitly shown in the drawings) and if a clearance is to be provided between the guide rod 167 and the guide pipe 168, a certain pivotability of these two guide elements 165 and 166 in the direction of the double arrow 125 can also be achieved, so that the two pressure plates 1 and 40 can perform at least small pivoting movements during the tensioning operation in this case as well.

The pivotability in the direction of the double arrow 126 is guaranteed by the two pivot bearings 155 and 141, the guide pipe 168 being pivotable around the pivot axis 156 of the pivot bearing 155. Other guide means of a similar design are also conceivable, such as those described as an example in FIGS. 3, 5 and 6, and which likewise permit a certain pivotability of the two pressure plates 1 and 40 in relation to one another, but at the same time ensure the securing of these two pressure plates 1 and 40 against rotation in relation to one another.

Figure 7:
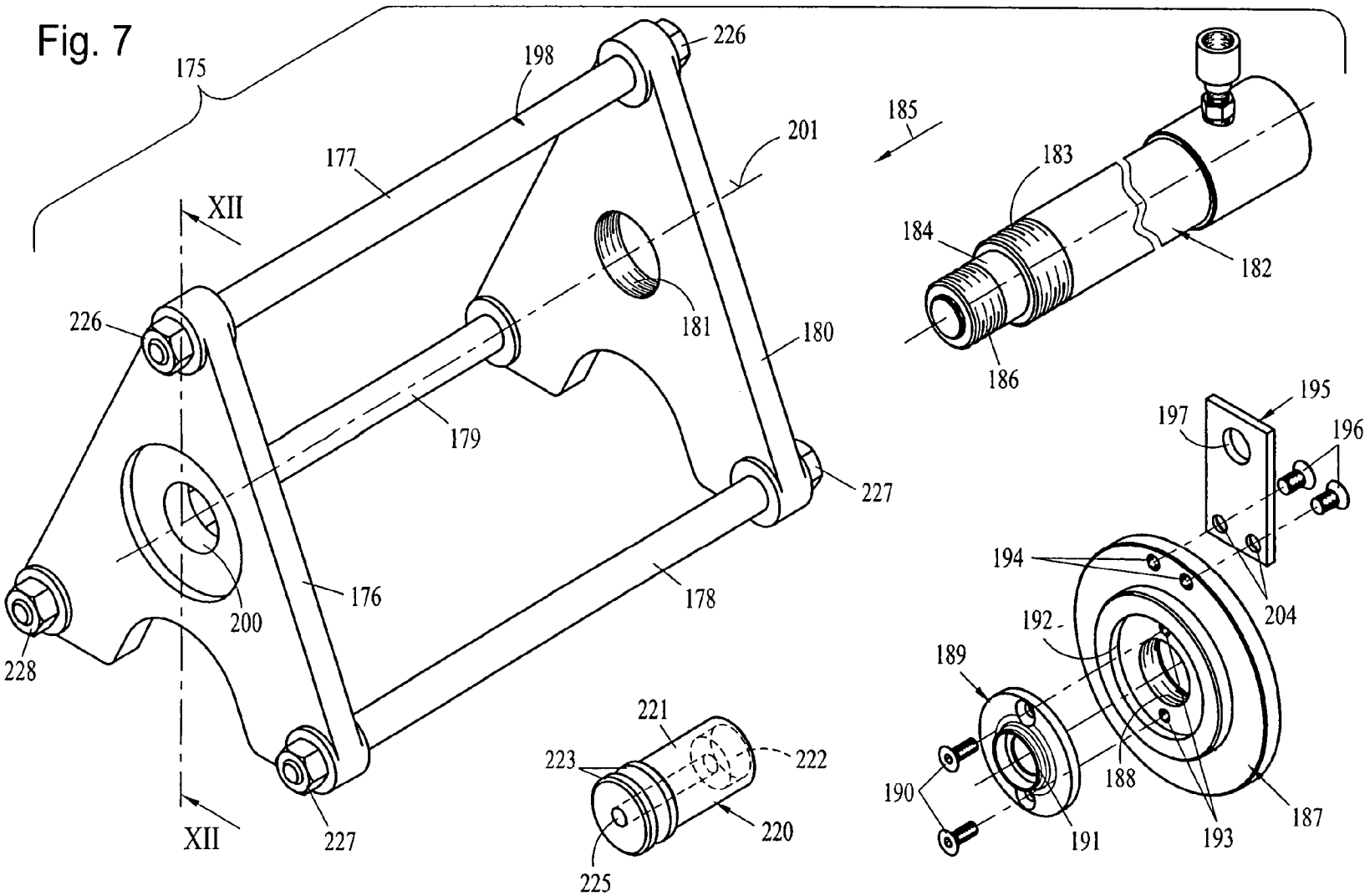
FIG. 7 is a perspective exploded view of a pretensioning means.

If coil springs whose unloaded initial length is greater than the tensioning travel of the tensioning device comprising the threaded pipe 2 and the threaded spindle 41 are to be tensioned with the above-described spring vice 120, an additional pretensioning means 175 is provided, whose essential components are shown as an example in FIG. 7.

Thus, this pretensioning means 175 has a first tensioning plate 176, which is rigidly in connection in this exemplary embodiment with a support plate 180 via three support rods 177, 178 and 179. The support plate 180 has a central threaded hole 181, into which a pressing device in the form of a hydraulic cylinder 182 can be removably screwed. This hydraulic cylinder 182 has a corresponding external threaded section 183 at one of its ends for this purpose. In the area of this external threaded section 183, a piston rod 184 protrudes from the hydraulic cylinder, and this piston rod performs an adjusting movement in the direction of the arrow 185 on activation of the hydraulic cylinder 182. At its outer end, this piston rod 184 is likewise provided with an external threaded section 186, on which a second tensioning plate 187 can be screwed in a firmly seated manner.

This tensioning plate 187 is designed as a round disk in this exemplary embodiment and has a corresponding, central internal threaded section 188 for mounting on the piston rod 184.

During the operation, a coil spring to be tensioned is accommodated between this tensioning plate 187 and the first tensioning plate 176, and this coil spring is shortened upon activation of the hydraulic cylinder 182. The coil spring is in contact with the tensioning plate 187 with one of its end turns and with the tensioning plate 176 with its other end turn. To take up such an end turn in a centered manner, the tensioning plate 187 according to this exemplary embodiment has a centering disk 189, which can be removably connected with the tensioning plate 187 concentrically with the tensioning plate 187 by means of two mounting screws 190. This centering disk 189 is provided in this exemplary embodiment with a central centering dome 191, whose diameter is adapted to the diameter of the end turn of a coil spring to be tensioned, which said end turn is to be accommodated.

Different centering disks 189 with different centering domes 191 can be provided here for tensioning different coil springs, so that coil springs with end turns of different diameters can be accommodated in a centered manner by the tensioning plate 187. Furthermore, it can be recognized from FIG. 7 that concentrically with its internal threaded section 188, the tensioning plate 187 has a circular hollow 192 with two internal threaded sections 193, so that the centering disk 189 can be accommodated in the tensioning plate 187 in a centered and removable manner.

Figure 12:
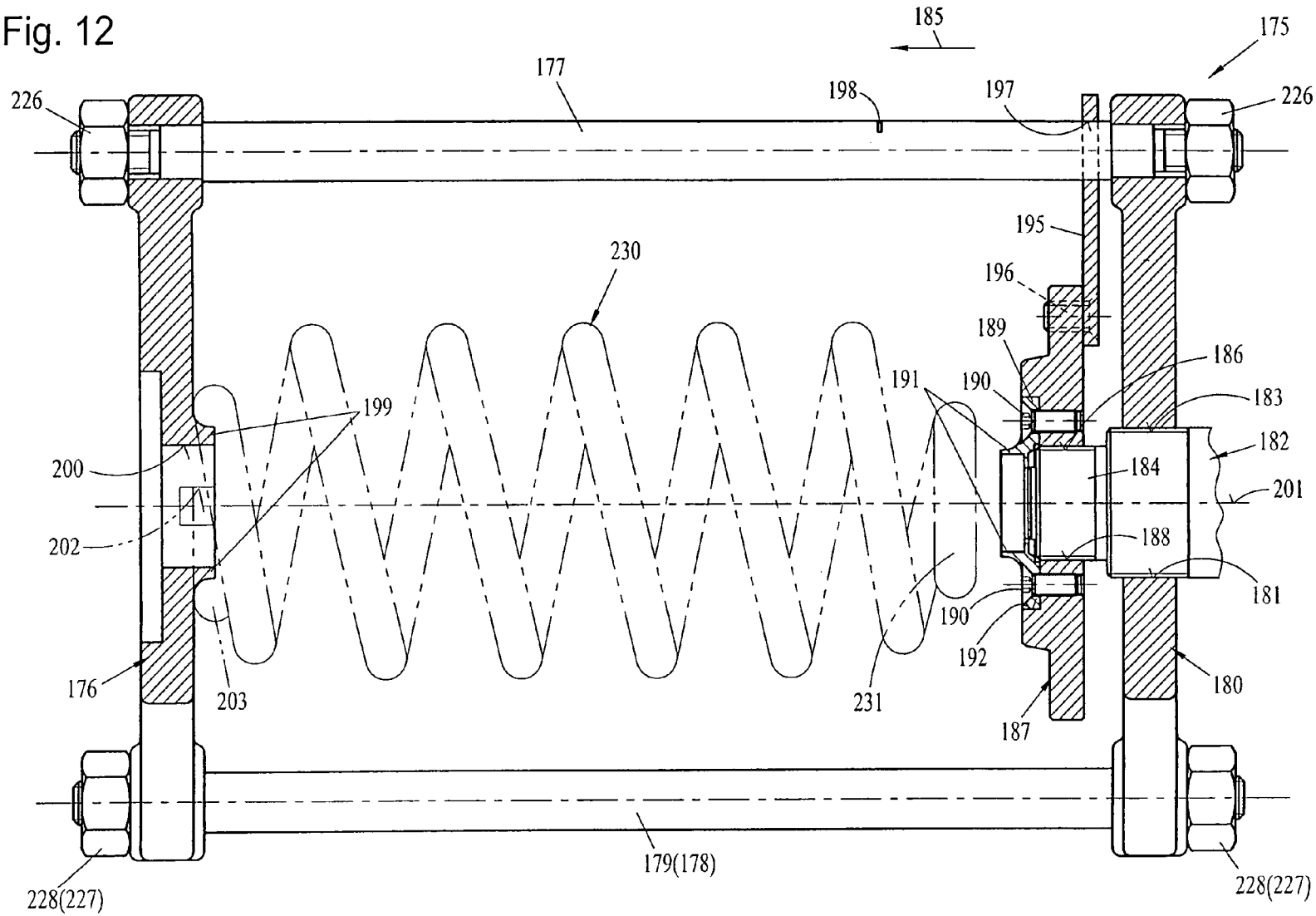
FIG. 12 is a sectional view XII—XII of the pretensioning means with the coil spring from FIG. 7.

Furthermore, above the hollow 192 in its radially outer edge area, the tensioning plate 187 is provided with two internal threads, at which a marking plate 195 can be removably fastened by means of two mounting screws 196. In the mounted state, as this is shown in FIG. 12, this mounting plate 195 projects radially upwardly over the tensioning plate 187. Furthermore, a through hole 197, by means of which the mounting plate 195 is guided axially displaceably at the support rod 177 in the mounted state, is provided in the radially outer area in the marking plate 195.

To set a tensioning path that can be predetermined, this support rod 177 has a visible mark 198. This mark 198 determines the pretensioning path that must be traveled to pretension the coil spring to the extent that the spring vice 120 with its two pressure plates 1 and 40 as well as with a tensioning device comprising the threaded pipe 2 and the threaded spindle 41 can be inserted at the coil spring. After the coil spring has been pretensioned to the mark 198, the spring turns of the pretensioned coil spring are located at an axial distance from one another that permits the two pressure plates 1 and 40 to be inserted between two adjacent spring turns radially laterally from the outside. On the other hand, a sufficient number of spring turns can be accommodated between the two pressure plates 1 and 40 because of this pretensioning, and the axial distance between the pressure plates is just great enough for the threaded spindle 41 with its threaded section 84 to be able to be screwed into the threaded pipe 2 in the attached state. The coil spring can thus be tensioned completely "until blocking" by means of the spring vice 120 and, if necessary, with the support of the hydraulic cylinder 182. After this tensioning operation, the hydraulic cylinder 182 can be removed from the pretensioning means 175 together with the completely tensioned coil spring and subsequently installed in a motor vehicle.

Figures 8, 9, 10, 11:
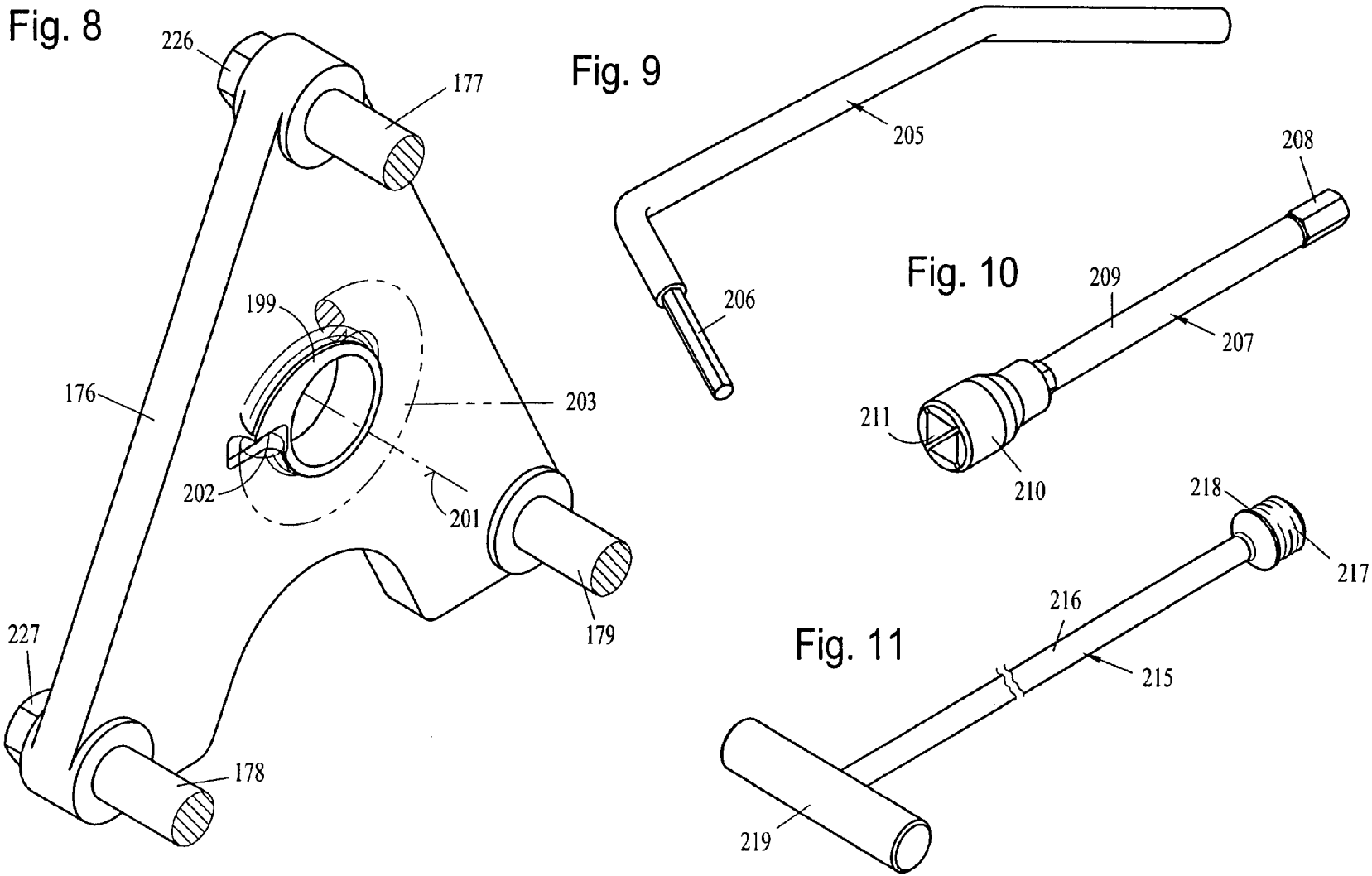
FIG. 8 is a partial perspective view of a support plate of the pretensioning means from FIG. 7.
FIG. 9 is a perspective view of a stop lever.
FIG. 10 is a perspective view of a wrench.
FIG. 11 is a perspective view of a positioning tool.

To make it possible now to insert such a coil spring in the pretensioning means 175 in the correct angular alignment, the first tensioning plate 176 likewise has a centering dome 199, as this is shown in FIG. 8. This centering dome 199 is provided with a through hole 200, through which the spindle head 85 of the spring vice 120 is accessible in the attached state by means of a wrench. Furthermore, an axially projecting stop 202, which extends radially in relation to the central longitudinal axis 201 of the centering dome 199 and is provided for the defined alignment of the angular position of a coil spring to be tensioned, is provided at the centering dome 199. The position of the end of the end turn of the coil spring, which said end turn is to be accommodated, is set by this stop 202, and this position is indicated by phantom lines and is designated by the reference number 203 in FIG. 8.

This angular alignment in relation to the tensioning plate 176 is necessary for tensioning coil springs that are inserted in the motor vehicle in a bent shape. The spring vice 120 must be inserted now into the coil spring such that its guide elements, for example, 90 and 91. will be arranged on the outside of the curvature of the coil spring during the subsequent mounting of the coil spring in the motor vehicle.

If the coil spring has been inserted into the pretensioning means 175 and pretensioned correctly, the spring vice 120 with its two guide elements 90 and 91 is aligned such that, for example, these guide elements 90 and 91 will be arranged directly vertically under the upper support rod 177. The coil spring is tensioned completely "until blocking" in this attached state and subsequently inserted into the motor vehicle in an angular position predetermined by the end turn of the coil spring. If the coil spring has been aligned correctly in the pretensioning means 175 and the angle of the spring vice 120 with its two guide elements 90 and 91 has been aligned correctly with the outside of the curvature of the coil spring, there can be no collision in this angular position at the time of the subsequent release between the guide elements 90 and 91 and the coil spring, which is curved during the release operation.

FIG. 7 shows, furthermore, a centering sleeve 220, which has a cylindrical centering section 221, at the free end of which a centering hole 222 is provided. At its end located opposite this centering hole 222, the centering sleeve 220 has a radially expanding grip section 223. This centering sleeve 220 can be inserted axially displaceably into the central through hole 200 of the tensioning plate 176 of the pretensioning means 175. This centering sleeve 220 is used with its centering hole 222 to receive the spindle head 85 of the threaded spindle 41 in a centered manner. Furthermore, as is apparent from FIG. 7, the centering hole 222 is joined by a radially tapered through hole 225, through which a wrench 207 (FIG. 10) can be passed to drive the threaded spindle 41. During the tensioning or during the release of a coil spring inserted into the pretensioning means 175 together with the spring vice 120, the spindle head 85 is aligned by this centering sleeve 220 in a centered manner in relation to the through hole 200, so that the hexagon socket 88 of the spindle head 85 is always accessible by means of the wrench 207. This centering sleeve 220 is advantageous because of the deformations are located axially outside the two pressure plates 1 and 40 of the spring vice 120, which deformations always occur during the tensioning and release of a coil spring, because these deformations of these spring turns leads to an eccentric offset of the coil spring as well as of the spring vice 120 in relation to the central longitudinal axis 201 of the pretensioning means 175. This offset may be so great in the extreme case that the hexagon socket 88 of the spindle head 85 can be reached with the wrench 207 with difficulty at best.

FIG. 9 shows as an example an exemplary embodiment of a stop lever 205, which can be caused to engage the hexagon socket 131 of the bushing 130 in a positive-locking manner. At one of its ends, this stop lever 205 has a hexagon insert bit 206 for this purpose, which can be fittingly inserted into the hexagon socket 131 of the bushing 130. Due to this positive-locking connection between the stop lever 205 and the bushing 130, the setting of the angular position of the bushing 130 together with the guide plate 90 and consequently with the second pressure plate 1 is considerably simplified in the mounted position. Furthermore, together with the coil spring tensioned completely between the axle body and the body of the motor vehicle, the spring vice can be aligned during the installation of a coil spring with the upper spring mount of the body, which said spring mount is located at the body, so that the installation is considerably simplified during the release of the coil spring. Provisions may be made in this connection for placing a ring-shaped rubber mount, which is to be aligned with the corresponding bearing seat of the body, on the upper end turn of the coil spring before the installation. This design is, furthermore, also advantageous during the attachment of the spring vice 120 to a coil spring to be tensioned both on the vehicle and in the pretensioning means 175. As is also apparent from FIG. 9, this stop lever 205 has multiple bends, so that it can also be used in a simple manner on the vehicle, where the space conditions may sometimes be crowded.

FIG. 10 shows a specially designed wrench 207, which is provided for driving the threaded spindle 41 via the spindle head 85 of the threaded spindle. At one of its ends, the wrench 207 has for this purpose a hexagon insert bit 208, which can be brought into connection with the threaded spindle 41 shown in FIG. 2 in a positive-locking manner in such a way that the connection is adapted to rotate in unison. This hexagon insert bit 208 is joined in the axial direction by a radially tapered shank section 209, which has a cylindrical jacket surface. Because of the cylindrical design of this shank section 209 as well as the radially tapered circular cross section thereof, it is achieved, especially when this wrench 207 is used on a motor vehicle, that the rubber mount cannot be damaged during the actuation of the spring vice 120 in the area of the bearing dome provided at the axle body for the coil spring, which said bearing dome is frequently provided with such rubber bearings. At its end located opposite the hexagon insert bit 208, the wrench 207 is provided with a coupling element 210, which is provided in this exemplary embodiment with a square socket 211, via which the coupling element 210 and consequently the wrench 207 can be brought into connection adapted to rotate in unison with a correspondingly designed rotary lever or a so-called "ratchet." Due to this design of this wrench 207 with its relatively long shank section 209, actuation of the spring vice 120 and of the threaded spindle 41 is possible in a very simple and reliable manner both at the motor vehicle and during use in connection with the pretensioning means 175.

FIG. 11 shows a positioning tool 215, which is provided for inserting the threaded pipe 2 into the second pressure plate 1. This positioning tool 215 has a relatively long shank 216 for this purpose, at one end of which a threaded section 217 is provided. This relatively short threaded section 217 is axially limited toward the shank 216 by a radially expanded stop web 218. At its end located opposite the threaded section 217, the positioning tool 215 has a transversely extending handle 219, by means of which the positioning tool 215 can be handled in a rotating manner.

To insert the threaded pipe 2 from FIG. 1 into the second pressure plate 1, the positioning tool 215 is screwed with its threaded section 217 into the internal thread 29 of the threaded pipe 2. The threaded pipe 2 can then be introduced with the positioning tool 215 into the opening 3 of the second pressure plate 1 and its radial fingers 31 and 32 can be caused to engage the hollows 23 and 24 of this opening 3 of the pressure plate 1 in a simple manner. This procedure is especially advantageous in case of use at a motor vehicle, because the pressure plate 1 inserted into the coil spring installed in the vehicle is accessible there with difficulty only. If the threaded pipe 2 with its radial fingers 31 and 32 is in connection with the hollows 23 and 24 of the pressure plate 1 in such a way that they are adapted to rotate in unison, the positioning tool 215 can subsequently be turned out of the threaded pipe 2 with its threaded section 217, so that the threaded spindle 41 can subsequently be screwed with its threaded section 84 into the internal thread 29 of the threaded pipe 2. The possibility of the threaded pipe 2 slipping accidently out of the second pressure plate 1 is reliably ruled out now in conjunction with the safety plate 245 from FIG. 15. After the removal of the positioning tool 215 and before the insertion of the threaded spindle 41 into the threaded pipe 2, the first pressure plate 40 is to be inserted with the bearing housing 42 into the intended spring turn of the coil spring, so that the threaded spindle 41 with its spindle head 85 will be in axial pulling connection with the thrust bearing 43. The tensioning of the coil spring can be subsequently carried out by means of the wrench 207 by further tightening the threaded spindle 41.

FIG. 12 shows a vertical longitudinal section XII—XII through the completely mounted pretensioning means 175. It can be recognized that the first tensioning plate 176, extending in parallel to the support plate 180, is rigidly connected with via the support rods 177, 178 and 179. The support rods 177, 178 and 179, of which the "front" support rod 178 is not visible in FIG. 12, are detachably connected with one another by means of clamping nuts 226, 227 and 228 (cf. FIG. 7). The hydraulic cylinder 182 is screwed with its external threaded section 183 in a fixed manner into the threaded hole 181 of the support plate 180. In the starting position shown in FIG. 12, the piston rod 184 is in an axially withdrawn position in relation to the arrow 185 and projects over the hydraulic cylinder 182 essentially with its external threaded section 186 only.

The second tensioning plate 187 is screwed in a fixed manner with its internal threaded section 188 on this external threaded section 186. Furthermore, the centering disk 189 is mounted in the hollow 192 of the tensioning plate 187 in a fixed manner by means of the two mounting screws 190. The centering dome 191 projects over the tensioning plate 187 and consequently also the piston rod 184 in the axial direction toward the first tensioning plate 176.

Furthermore, the marking plate 195 is mounted at the tensioning plate 187 in a fixed manner in the radially outer edge area of the tensioning plate 187 by means of the mounting screws 196. The upper support rod 177 is accommodated by the through hole 197 of the marking plate. This marking plate 195 is consequently also used to nonrotatably align the tensioning plate 187. When the hydraulic cylinder 182 is activated, the tensioning plate 187 moves together with the marking plate 195 in the direction of arrow 185, so that the marking plate 195 with its through hole 197 slides axially along the support rod 177.

As can also be seen in FIG. 12, the centering dome 199 projects over the first tensioning plate 176 in the axial direction against the arrow 185 toward the support plate 180. As was already described in connection with FIG. 8, the end turn 203 of a coil spring 230 indicated by phantom lines in FIG. 12 is accommodated by this centering dome 199 in a centered manner. This end turn 203 is now in contact by its end turn 203 with the radial stop 202 of the centering dome 199, which said stop is likewise indicated by phantom lines. The coil spring shown in FIG. 12 is thus aligned correctly in its angular position in relation to the central longitudinal axis 201 of the entire pretensioning means 175.

It is easy to imagine that when the hydraulic cylinder 182 is activated, the second tensioning plate 187 is moved in the direction of arrow 185 until the second tensioning plate 187 with the centering dome 191 of its centering disk 189 engages the second end turn 231 of the coil spring 230. By activating the hydraulic cylinder 182 further, the coil spring 230 is now pretensioned, and the first pretensioning path is defined by the mark 198 of the upper support rod 177.

Figure 13:
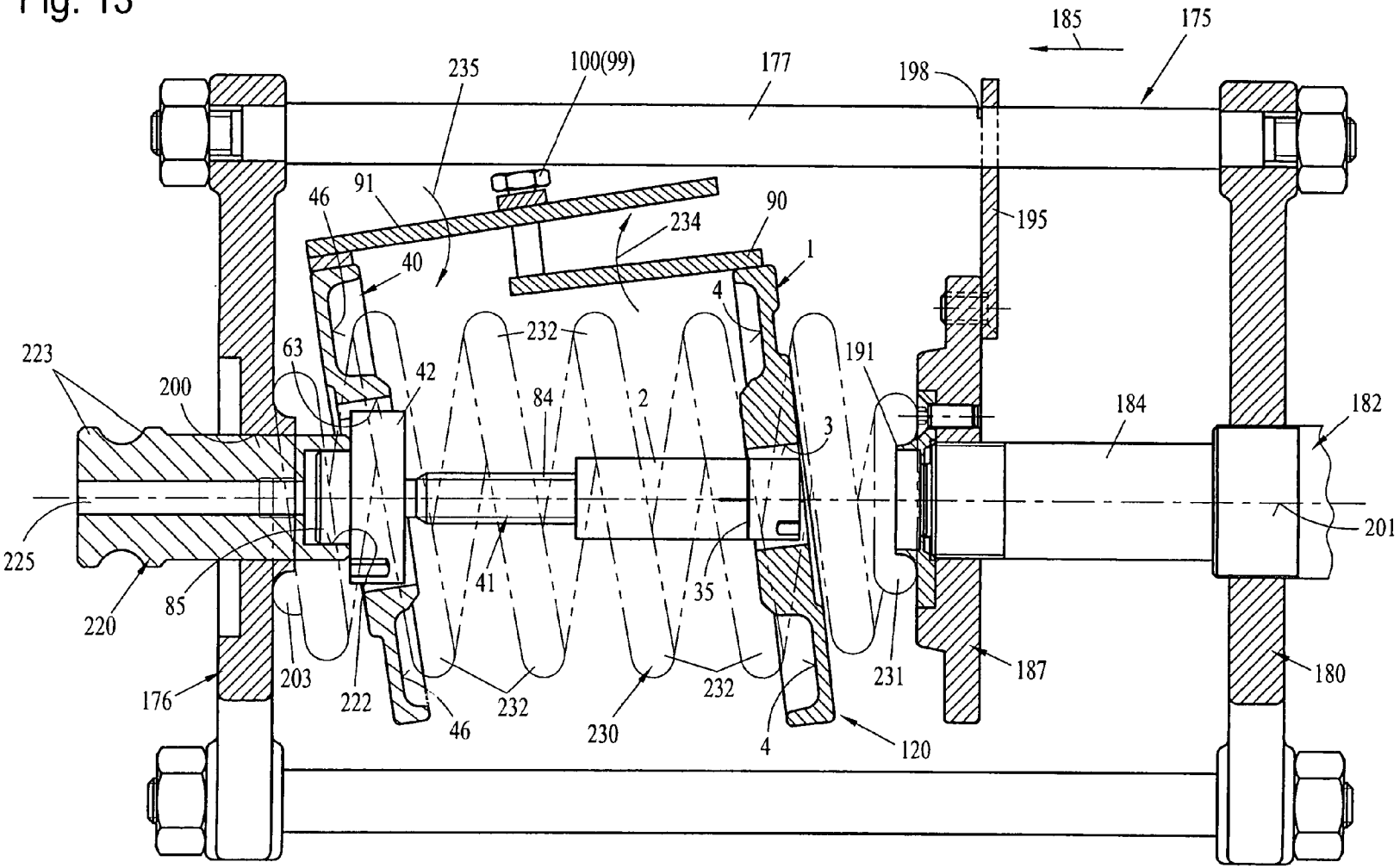
FIG. 13 is the view from FIG. 12 with the pretensioned coil spring and the attached spring vice.

FIG. 13 shows the pretensioning means 175 after having traveled this first pretensioning path in the direction of arrow 185. It can be recognized that the marking plate 195 is located directly adjacent to the mark 198 of the support rod 177. Furthermore, it can also be recognized that the second end turn 231 of the coil spring 230 is accommodated by the centering dome 191 in a centered manner. The spring vice 120 from FIG. 4 can now be attached to the coil spring 230 in this first pretensioned position of the coil spring 230. The alignment of the two pressure plates 1 and 40 is predetermined now by the positions of the two mounted guide plates 90 and 91.

Both pressure plates 1 and 40 are aligned in this exemplary embodiment such that the two guide plates 90 and 91 are located directly below the upper support rod 177. The two guide means 90 and 91 are aligned correctly now for the subsequent installation in a motor vehicle in relation to the coil spring 230, which is inserted correctly between the two support plates 176 and 187.

As is also apparent from FIG. 13, the two fillister head screws 99 and 100 pass through the first guide plate 91, as this can also be seen as an example in FIG. 4. Because of the existing pitch of the middle spring turns 232, the two pressure plates 1 and 40 can also be inserted in a slightly sloped direction into these spring turns 232 radially laterally from the outside. After the second, "upper" pressure plate has now been inserted into the coil spring 230 or into one of the axially outer spring turns 232 of the coil spring 230, the threaded pipe 2 is caused at first to engage the second pressure plate 1, for example, by means of the positioning tool 215 from FIG. 11, and this engagement can be recognized in FIG. 4.

If the threaded pipe 2 is seated correctly in the opening 3 of the pressure plate 1, as this can be recognized from FIG. 13, the ring mark 35 can be recognized by the installer on the underside. This means for the installer that the threaded pipe with its two radial fingers 31 and 32 is inserted correctly into the two hollows 23 and 24 of the pressure plate 1. The safety plate from FIG. 15 can then be brought from its neutral position into the locked position shown in FIG. 15, so that the threaded pipe 2 is captively fixed in the second pressure plate 1 (not shown in the drawing). The positioning tool 215 is again unscrewed from the threaded pipe 2 in the next step, the first pressure plate 40 is inserted into the coil spring 230, and the threaded spindle 41 is passed with its threaded section 84 through the bearing housing 42 and brought into engagement with the threaded pipe 2 by screwing the threaded section 84 into the threaded pipe 2. The bearing housing 42 is now seated already in the opening 63 of the first pressure plate 40.

It can be recognized that the bearing housing 42 is pivotable in relation to the pressure plate 40, so that the spindle head 85 is accommodated correctly in the bearing housing 42 or in the support ring 44. The threaded spindle 41 is now actuated by rotation from this position shown in FIG. 13 until the two pressure plates 1 and 40 grasp the corresponding adjacent spring turn 232 with their tensioning surfaces 4 and 46. To prevent now a radial, non-central adjustment of the spindle head 85 in relation to the opening 200 of the support plate 176 during the further tensioning operation, but also already during the attachment of the pressure plates 1 and 40 to the spring turns 232, the centering sleeve 220 is provided, as was already mentioned in connection with FIG. 7.

This centering sleeve 220 is pushed by hand fittingly into the through hole 200 by its grip section 223 until the threaded hole fittingly receives the spindle head 85 with its centering hole 222. The wrench 207 from FIG. 10 with its hexagon insert bit 208 and with its cylindrical shank section 209 is subsequently passed through the through hole 225 of the centering sleeve 220 until the hexagon insert bit 208 fittingly engages the hexagon socket 88 of the spindle head 85, which is visible in FIG. 2.

The coil spring 230 is shortened more during the further tensioning operation, while the hydraulic cylinder 182 and the threaded spindle 41 are activated here at the same time. The bearing housing 42 is now displaced while the angular position of the pressure plate 40 changes at the same time in the direction of arrow 185, so that the centering sleeve 220 is pushed automatically out of the through hole 200 of the support plate 176 with increasing tensioning path in the direction of arrow 185. The centering sleeve 220 always continues to engage the spindle head 85 via its centering hole 222, so that the spindle head 85 always remains reliably concentric with the central longitudinal axis 201 of the through hole 200 or the complete pretensioning means 175 via this centering sleeve 220 during the complete tensioning operation.

The two guide plates 90 and 91 are likewise pivoted in the corresponding direction indicated by the two arrows 234 and 235 during the pivoting movement of the two pressure plates 1 and 40 due to the fact that the pitch of the spring turns 232 changes and becomes flatter during the tensioning operation until these guide plates extend in parallel to one another and lie flat on one another at the end of the tensioning operation.

Due to the pitch of the two tensioning surfaces 4 and 46 of the pressure plates 1 and 40, the two guide plates 90 and 91 extend essentially in parallel to one another and in parallel to the central longitudinal axis of the coil spring 203, which said central longitudinal axis is congruent with the central longitudinal axis 201 of the pretensioning means 175 in FIG. 13, in the completely tensioned state of the two guide plates 90 and 91. Because of the length of the fillister head screws 99 and 100, this pivoting movement is not hindered with certainty, because the two fillister head screws 99 and 100 are radially adjustable in the guide slots 111 and 112 in relation to the central longitudinal axis 122 of the spring vice 120, as this is also apparent from FIG. 4.

After complete tensioning—by the simultaneous activation of the hydraulic cylinder 182 as well as of the threaded spindle 41—the hydraulic cylinder 182 is again released, so that the piston rod 184 is withdrawn against the arrow 185 and the "set" comprising the spring vice 120 and the coil spring 230 can be removed from the pretensioning means 175.

This "set" can subsequently be introduced into a motor vehicle between the axle body of the vehicle axle and the body and again released by actuating the threaded spindle 41. The spring vice 120 can be aligned with the upper spring mount of the body by means of the stop lever 205 from FIG. 9 in conjunction with the bushing 130 together with the coil spring 230 tensioned completely between the axle body and the body. A special alignment of the angle of the coil spring 230 in relation to the axle of the motor vehicle is usually to be observed, and it is important in this connection in case of a coil spring installed in a vehicle in a curved shape for the two guide plates 90 and 91 to be arranged radially outside the coil spring in relation to the center of curvature of the coil spring in order not to hinder the pivoting movement of the two pressure plates 1 and 40 which occurs during the release. After complete release of the coil spring, the pressure plates 1 and 40 can now be removed radially from the spring turns 232 of the coil spring 230 together with the guide plates 90 and 91 after the removal of the threaded spindle 41 and the threaded pipe 2.

The tensioning operation of an installed coil spring takes place correspondingly in a reverse order, the pretensioning means being used for the complete release here.

The set comprising the coil spring 230 and the spring vice 120 with the coil spring 230 tensioned completely is inserted into the pretensioning means 175 and slightly pretensioned by means of the hydraulic cylinder 182. The coil spring 230 can now be released by subsequently releasing both the hydraulic cylinder 182 and the threaded spindle 41 to the pretensioned position shown in FIG. 13 to the extent that the spring vice 120 can be removed from the coil spring 230. The hydraulic cylinder 182 is subsequently released completely, so that the coil spring 230 can be completely removed from the pretensioning means 175, as this is apparent from FIG. 12.

Figure 14:
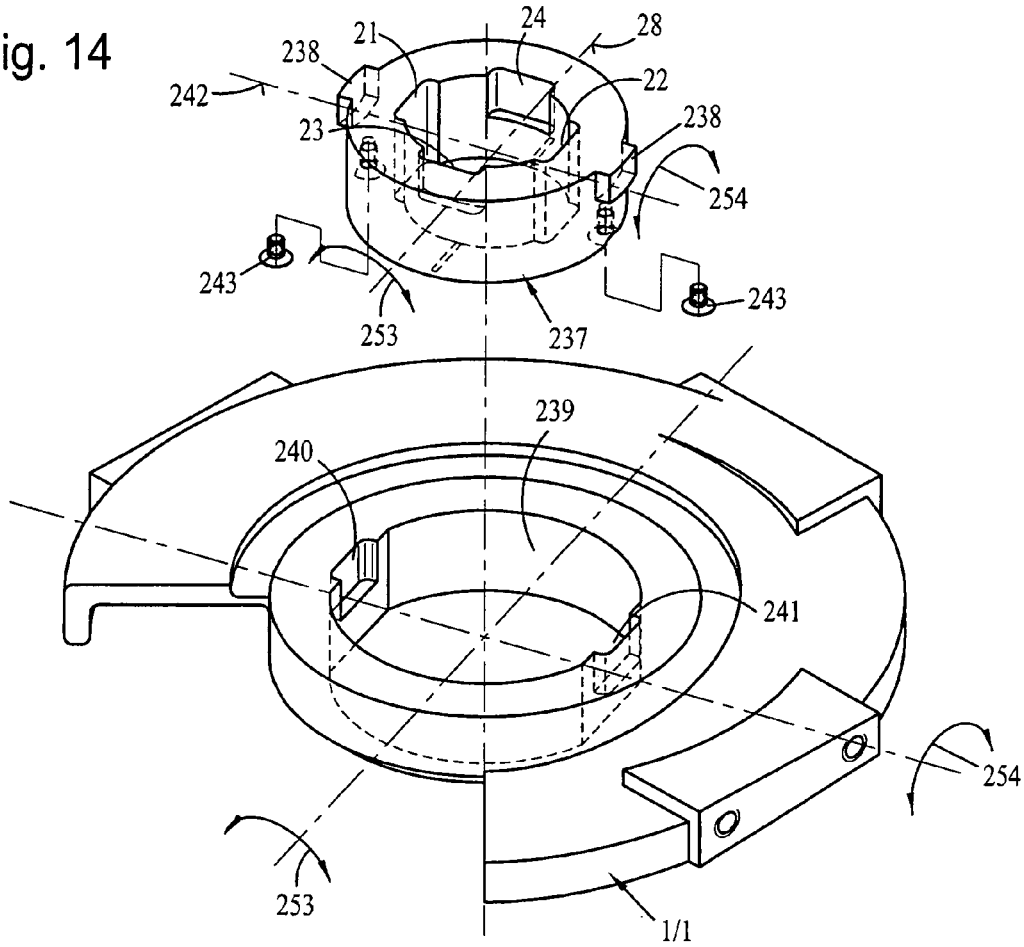
FIG. 14 is a perspective exploded view of a second exemplary embodiment of an upper pressure plate, whose opening with the hollows of the opening are part of a separate bearing ring.

FIG. 14 shows a second exemplary embodiment of a second, upper pressure plate 1/1, in which the opening 3 is part of a separate bearing ring 237. The two radial expansions 21 and 22 as well as the two hollows 23 and 24, whose design and arrangement correspond to those of the radial expansions 21 and 22 and of the hollows 23 and 24 of the exemplary embodiment of the pressure plate 1 from FIG. 1, are likewise provided in the edge area of the opening 3. Thus, the two hollows 23, 24 located diametrically opposite likewise define a pivot axis 28 in cooperation with the two radial fingers 31, 32 of the threaded pipe 2 shown in FIG. 1.

In the circumferential area of the two radial expansions 21, 22, the bearing ring 237 has two radially outwardly projecting bearing webs 238, which are located at right angles to the two hollows 23, 24 and diametrically opposite each other. The bearing ring 237 can be inserted with these bearing webs 238 into a through opening 239 of the pressure plate 1/1 and can be caused to engage two depressions 240 and 241 located diametrically opposite each other in the edge area of the through opening 239. Thus, the two bearing webs 238 define, in cooperation with the depressions 240 and 241 of limited axial length of the through opening 239, a second pivot axis 242 extending at right angles to the pivot axis 28. Due to this design, the pressure plate 1/1 can be pivoted in any direction in relation to the threaded pipe 2 inserted into the bearing ring 237, as this is indicated by the two pivot arrows 253 and 254.

To secure the bearing ring 237 in the through opening 239, two securing screws 243 are likewise provided, just as in the bearing housing 42 from FIG. 2 of the first pressure plate 40, and the bearing ring 237 is captively held by these securing screws in the through opening 239 with an axial clearance on the order of magnitude of 1 mm to 3 mm. Concerning this securing by the two securing screws and the arrangement in the bearing ring 237, reference is made to the description given for the securing screws 73 and 74 in connection with FIG. 2. The angular position of the pressure plate 1/1 in relation to the coil spring can be adapted as desired to different pitches of a coil spring due to this design of the mounting of the threaded pipe 2.

A system for the absolutely secure tensioning of a coil spring, which is inserted into an extremely crowded space in a motor vehicle, is made available with the design of this system according to the present invention, but especially of the coil spring 120 shown completely in FIG. 4. On the one hand, extremely high work safety is achieved due to the securing against rotation by means of the guide means in the radially outer edge area of the pressure plates, and, on the other hand, a tensioning device comprising the threaded spindle 41 and the threaded pipe 2 can be prepared, which has an extremely small maximum external diameter, so that this tensioning device with its threaded spindle 41 and its threaded pipe 2 can also be pushed through small through holes. The system according to the present invention with its spring vice 120 according to the present invention can thus be used reliably under working conditions in such unfavorable crowded spaces as well.

It shall also be mentioned here that the pretensioning means 175 is not, of course, absolutely necessary in case of shorter coil springs.

While specific embodiments of the invention have been shown and described in detail to illustrate the application of the principles of the invention, it will be understood that the invention may be embodied otherwise without departing from such principles.

What is claimed is:

1. A system for tensioning a coil spring with a spring vice, the system comprising:

a first disk-shaped or strip-shaped pressure plate;

a second disk-shaped or strip-shaped pressure plate, each pressure plate having a central opening and being adapted to engage a spring turn of the coil spring for tensioning the coil spring;

a tensioning device including a threaded pipe, a threaded spindle and a thrust bearing, wherein said threaded spindle has a spindle head provided with a wrench profile and via which said threaded spindle is axially supported at said first pressure plate by said thrust bearing and wherein said threaded pipe has an end located axially opposite said spindle head with radially projecting radial fingers for bringing said threaded pipe into pulling connection with said second pressure plate and wherein said distance between said pressure plates can be shortened during said screwing in of said threaded spindle into said threaded pipe, said first pressure plate having a first guide means provided in a radially outer edge area, said second pressure plate having a second guide means arranged in said radially outer edge area of said second pressure plate in an axially adjustable manner, said first guide means being engageable with said second guide means to axially adjust said first pressure plate and said second pressure plate with said first pressure plate and said second pressure plate being nonrotatably and detachably connected with one another.

2. A system in accordance with claim 1, wherein said first guide means is formed from a first guide plate, which extends starting from said radially outer edge area of said first pressure plate toward said second pressure plate and is provided with at least one said guide slot extending approximately in parallel to said tensioning device, and said second guide means is formed from a second guide plate, which extends starting from said radially outer edge area of said second pressure plate toward said first pressure plate and is provided with at least one radially outwardly projecting guide element, which engages said guide slot of said first guide plate in a positive-locking and axially adjustable manner.

3. A system in accordance with claim 2, wherein said guide element or said guide elements of said second guide means is/are formed from one or more said guide pins, which can be screwed into said free end of said second guide plate.

4. A system in accordance with claim 2, wherein said guide pins are designed as fillister head screws and have a screw head with a wrench profile, and said length of said cylindrical section of said fillister head screws is greater than said thickness of said first guide plate, and said second guide plate with said fillister head screws engaging said guide slots of said first guide plate is displaceable in relation to said first guide plate both radially and axially.

5. A system in accordance with claim 2, wherein said guide plates are fastened to said respective pressure plate in such a way that said guide plates are mounted pivotably around a respective pivot axis extending approximately tangentially to said respective associated pressure plate and that said guide pins are designed as said fillister head screws and have a screw head with a wrench profile, and that said length of said cylindrical section of said fillister head screws is slightly greater than said thickness of said first guide plate.

6. A system in accordance with claim 1, wherein said first guide element of said first pressure plate is a guide rod fastened to said first pressure plate pivotably around a pivot axis extending approximately tangentially to said first pressure plate, and said second guide element includes a guide pipe or a guide ring, into which said guide rod can be pushed in an axially adjustable manner and which is fastened to said second pressure plate pivotably around a pivot axis extending approximately tangentially to said second pressure plate.

7. A system in accordance with claim 1, wherein at least one of said two guide means of one of said pressure plates can be fastened in different, predefined positions in said edge area of said respective pressure plate.

8. A system in accordance with claim 1, wherein one of said two guide elements or both of said guide elements is/are provided with a bushing extending essentially tangentially to said respective pressure plate, and into which a stop lever can be inserted.

9. A system in accordance with claim 7, wherein said bushing is provided with a hexagon socket, into which said stop lever can be pushed in a fixed manner with a hexagon insert bit in different angular positions.

10. A system in accordance with claim 1, wherein two of said radial fingers located diametrically opposite each other are provided at said threaded pipe of said tensioning device, and said second pressure plate is mounted at said radial fingers pivotably in relation to said threaded pipe.

11. A system in accordance with claim 10, wherein said second pressure plate has an opening and two hollows located diametrically opposite each other and defining a pivot axis in an edge area of said opening for mounting at said radial fingers, said pivot axis extending at an angle of about 0E to 30E to a plane of symmetry of a recess of said second pressure plate, said recess being provided for passing through axially a spring turn accommodated by said pressure plate.

12. A system in accordance with claim 11, wherein said hollows are part of a separate bearing ring having radially outwardly projecting bearing webs located diametrically opposite each other and extending at right angles to said hollows whereby said bearing ring can be brought pivotably into engagement with two said depressions of said second bearing plate, which said depressions are arranged in said edge area of a through opening pivotably accommodating said bearing ring, and bearing webs define a second pivot axis extending at right angles to said pivot axis in cooperation with said depressions.

13. A system in accordance with claim 1, wherein said second pressure plate has a locking means axially on an outside, said locking means being brought from a neutral position into a locked position, in which said central opening for receiving said threaded pipe with said radial fingers can be closed at least partially.

14. A system in accordance with claim 1, wherein said spindle head of said threaded spindle fittingly engages said thrust bearing, and said thrust bearing is accommodated in a bearing housing having two radially outwardly projecting bearing webs located diametrically opposite each other and at which said first pressure plate is mounted pivotably in relation to said threaded spindle.

15. A system in accordance with claim 14, wherein said first pressure plate has an opening and two hollows located diametrically opposite each other and defining a pivot axis in an edge area of said opening for mounting at said bearing webs of said bearing housing, said pivot axis extending at an angle of about 80E to 100E in relation to a plane of symmetry of a recess of said second pressure plate, and said recess is provided for passing through axially said spring turn accommodated by said pressure plate.

16. A system in accordance with claim 1, wherein said wrench profile of said spindle head of said threaded spindle has a hexagonal socket for a socket wrench with a hexagon insert bit that can be inserted fittingly into said hexagon socket of said spindle head for driving said threaded spindle, and said socket wrench has a, radially tapered, cylindrical shank section starting from said hexagon insert bit.

17. A system in accordance with claim 16, wherein said shank section is provided at an end located opposite said hexagon insert bit with a coupling element, via which said shank section can be brought into connection with a rotary lever or ratchet in such a way that they are adapted to rotate in unison.

18. A system in accordance with claim 1, further comprising a pretensioning means is provided for the spring vice, said pretensioning mans for shortening a coil spring to be tensioned from its nontensioned length to a pretensioned length, in which said spring vice with said two pressure plates and with said tensioning device can be caused to engage the coil spring.

19. A system in accordance with claim 18, wherein said pretensioning means has two tensioning plates, at which said coil spring is supported with two end turns, and said axial distance between said tensioning plates can be changed by means of a tensioning means.

20. A system in accordance with claim 19, wherein said pretensioning means includes a tensioning frame and said first two tensioning plates are integrated in said tensioning frame in a fixed manner, that said first tensioning plate being connected in a fixed manner with a support plate via support rods, and said support plate has a central pressing device by means of which said axial distance between said second tensioning plate and said first tensioning plate can be changed.

21. A system in accordance with claim 20, wherein said first tensioning plate has a central centering dome, to which said coil spring can be attached with an end turn, and starting from said centering dome, a radially outwardly directed stop is provided, by which an angular position of said coil spring in relation to a central longitudinal axis of said pretensioning means can be set in a defined manner in said pretensioning means.

22. A system in accordance with claim 19, wherein said second tensioning plate has a central centering dome for receiving said second end turn of said coil spring to be tensioned.

23. A system in accordance with claim 19, wherein said pressing device comprises a hydraulic cylinder with an axially adjustable piston rod, said second tensioning plate being removably fastened to said axially adjustable piston rod.

24. A system in accordance with claim 19, wherein a marking means, which is movable along one of said support rods during said tensioning movement of said first tensioning plate, is provided at said second, axially adjustable tensioning plate, and a visible mark, whose axial position defines said pretension of said coil spring at which said spring vice with said pressure plates and with said tensioning device can be attached to said coil spring, is arranged at said support rod.

25. A system in accordance with one of said claim 19, wherein said stationary first tensioning plate of said pretensioning means has a central through hole arranged within a centering dome and through which said hexagon socket of said spindle head of said tensioning device, which said hexagon socket is inserted into said coil spring, is accessible from said outside by means of a wrench.

26. A system in accordance with claim 25, wherein a centering sleeve is provided, which can be inserted into said through hole of said first tensioning plate in an axially displaceable manner and which can be caused to engage said spindle head of said tensioning device inserted into said coil spring for centering said tensioning device and for aligning same with said through hole.

27. A system in accordance with claim 1, further comprising a positioning tool to insert said threaded pipe into said pressure plate of said spring vice, said pressure plate engaging a spring turn of said coil spring which has at one of its ends a threaded section, whose said axial length is limited by a circumferential stop web and with which said positioning tool can be screwed into said threaded pipe, and said threaded pipe with said radial fingers can be passed by means of said positioning tool through said opening of said second pressure plate and can be rotated by 90E and can be caused to engage said two hollows of said second pressure plate in such a way that they are adapted to rotate in unison.

* * * * *